US006776239B2

(12) United States Patent
Eslinger et al.

(10) Patent No.: US 6,776,239 B2
(45) Date of Patent: Aug. 17, 2004

(54) TUBING CONVEYED FRACTURING TOOL AND METHOD

(75) Inventors: David M. Eslinger, Broken Arrow, OK (US); Stephen D. Hill, Pearland, TX (US); Randolph J. Sheffield, Missouri City, TX (US); Howard L. McGill, Lufkin, TX (US); James M. Costley, Freeport, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/078,963

(22) Filed: Feb. 19, 2002

(65) Prior Publication Data

US 2002/0125005 A1 Sep. 12, 2002

Related U.S. Application Data

(60) Provisional application No. 60/275,270, filed on Mar. 12, 2001.

(51) Int. Cl.[7] ..... E21B 23/00; E21B 43/26

(52) U.S. Cl. ..... 166/308.1; 166/386; 166/177.5; 166/240

(58) Field of Search ..... 166/281, 305.1, 166/308, 373, 381, 167, 382, 386, 387, 179, 118, 330, 177.5, 206, 212, 237, 240, 331, 242.7, 308.1

(56) References Cited

U.S. PATENT DOCUMENTS 3,710,862 A * 1/1973 Young et al. ..... 166/278
4,273,190 A * 6/1981 Baker et al. ..... 166/278
4,671,352 A * 6/1987 Magee et al. ..... 166/186
4,750,564 A * 6/1988 Pettigrew et al. ..... 166/387
4,781,250 A * 11/1988 McCormick et al. ..... 166/240
4,840,229 A * 6/1989 Proctor et al. ..... 166/381
4,913,231 A 4/1990 Muller et al.
5,020,592 A 6/1991 Muller et al.

(List continued on next page.)

OTHER PUBLICATIONS

"SST+ Stage Stimulation Tool 10–035", Camco Completion Systems, a Schlumberger company, Service Tools p. 1–15, undated.

(List continued on next page.)

*Primary Examiner*—David Bagnell
*Assistant Examiner*—Jennifer H Gay
(74) *Attorney, Agent, or Firm*—Wayne I. Kanak; Robin Nava; Brigitte L. Echols

(57) ABSTRACT

A tubing conveyed multi-position well treating tool having a tubular housing and a tubular inner member which are relatively positionable at "Set", "Treat", "Dump" and "Release" positions actuated by a mechanical indexing mechanism. The indexing mechanism is loaded by a spring, such as a compressed gas spring or mechanical spring, which urges the tubular housing away from the tubing connection of the inner tubular member, thus requiring no set-down forces for tool actuation or indexing. The treating tool is anchored within the well casing by hydraulic pressure actuated buttons, thus eliminating the typical requirement for anchoring actuation by set-down forces. The treating tool is sealed within the casing by pressure energized packers which are activated by the hydraulic pressure of fluid supplied from the tubing. The tool provides a bypass passage to allow communication of the zones above and below the tool while isolating the straddled interval to be treated.

38 Claims, 12 Drawing Sheets

U.S. PATENT DOCUMENTS

| | | | | | |
|---|---|---|---|---|---|
| 5,058,673 | A | | 10/1991 | Muller et al. | |
| 5,337,826 | A | * | 8/1994 | Barrington | 166/319 |
| 5,350,018 | A | * | 9/1994 | Sorem et al. | 166/250.07 |
| 5,381,862 | A | * | 1/1995 | Szarka et al. | 166/212 |
| 5,529,126 | A | * | 6/1996 | Edwards | 166/331 |
| 5,577,559 | A | * | 11/1996 | Voll et al. | 166/278 |
| 5,620,050 | A | * | 4/1997 | Barbee | 166/278 |
| 5,865,252 | A | * | 2/1999 | van Petegem et al. | 166/297 |
| 5,921,318 | A | * | 7/1999 | Ross | 166/250.17 |
| 5,947,200 | A | * | 9/1999 | Montgomery | 166/281 |
| 5,964,289 | A | * | 10/1999 | Hill | 166/250.1 |
| 6,186,236 | B1 | * | 2/2001 | Cox | 166/308 |
| 6,315,041 | B1 | * | 11/2001 | Carlisle et al. | 166/250.17 |
| 6,394,184 | B2 | * | 5/2002 | Tolman et al. | 166/281 |
| 6,474,419 | B2 | | 11/2002 | Maier et al. | |
| 6,510,899 | B1 | * | 1/2003 | Sheiretov et al. | 166/381 |
| 2003/0051876 | A1 | * | 3/2003 | Tolman et al. | 166/313 |

OTHER PUBLICATIONS

"Cobra Frac Coiled Tubing Fracturing Service", Halliburton HO2319 Dec. 1999, 2–pages.

"Jet Pack Straddle System" (Packers), Weatherford Drilling & Intervention Services, 2000, 1–p. Brochure.

"P–Type SIP Packer", Perforation Cleaning Systems, Halliburton, undated, p. 7–3.

"ISAP Inflatable Straddle Acidizing Packer System", Completions, Workovers and Fishing, Baker Hughes—Baker Oil Tools, 1999, 4–page Brochure.

* cited by examiner

DUMP POSITION

RELEASE POSITION

| POSITION | BYPASS | ELEMENT/ BUTTON | SETTING ORIFICE | TREAT PORT | DUMP PORT |
|---|---|---|---|---|---|
| 1 - SET | OPEN | RETRACTED | OPEN | CLOSED | CLOSED |
| 3 - TREAT | OPEN | SET | CLOSED | OPEN | CLOSED |
| 5 - DUMP | THROTTLED | SET | CLOSED | OPEN | OPEN |
| 7 - E-RELEASE | OPEN | RETRACTED | CLOSED | OPEN | OPEN |

TUBING CONVEYED FRACTURING TOOL AND METHOD

CROSS-REFERENCE TO RELATED APPLICATIONS

Applicants hereby claim the benefit of U.S. Provisional Application No. 60/275,270, filed on Mar. 12, 2001, which Provisional Application is incorporated herein by reference for all purposes.

BACKGROUND OF THE INVENTION

1. Field of the Invention

This invention relates generally to formation interval straddle tools that are employed for formation zone fracturing or other formation treating operations. More particularly, the present invention concerns a tubing conveyed multi-position treating tool having "Set", "Treat", "Dump" and "Release" positions which are achieved by a mechanical indexing mechanism loaded by a compressed gas or mechanical return spring, and which requires no set-down forces for actuation. Even more particularly, the present invention concerns a treating tool that is anchored by injection pressure actuated buttons and sealed to the well casing by injection pressure energized packers. This invention also concerns a treating tool which provides a bypass passage across the isolated interval to allow continuous communication between the zones above and below the straddled interval when the tool is "Set" or is engaged in the process of formation treating.

2. Description of Related Art

State-of-the-art coiled tubing (CT) conveyed straddle tools used for coiled tubing fracturing are generally either 1) tools with upper and lower cup packers with a single operating position ("Treat"), or 2) tools with an upper cup packer and a lower mechanically set squeeze packer and at most three operating positions ("Unset", "Set/Treat" and "Dump").

Tools of the first type require reverse circulation after fracturing a zone to clean slurry left in the CT and between the cups. This is a severe limitation when low pressured zones will not allow reliable reverse circulation and due to safety issues of permitting flowback of well fluids to surface through the CT. These tools are generally limited to operation shallower than 5000 feet true vertical depth (TVD) because of the high CT swabbing forces when trying to pull-out-of-hole (POOH) after treatment since the fluid in the annulus must be lifted to surface by the lower cup. Further, the state-of-the-art in cup packer technology generally limits fracturing differentials to about 6000 pounds per square inch and to wells with measured depths (MD) less than 10,000 feet because of abrasive wear on the cups.

Recent advances in the art of formation fracturing address some of these issues. For example, a tool bypass passage that allows continuous communication from the zone above the straddle interval to the zone below limits the high swabbing forces when POOH. Further, a hydraulically operated dump valve eliminates the need for reverse circulation in some wells. However, even with these advances, operation is not permitted in severely under-pressured wells, in wells with a maximum depth greater than about 10,000 feet, or in wells where the fracturing differentials exceed 6000 pounds per square inch.

Tools of the second type have all of the limitations of the dual-cup style tool except that they can be operated in wells up to about 10,000 feet total depth (TD) since there are no high swabbing forces during POOH after the conventional squeeze packer is unset. Reverse circulation is still required because slurry will cause packer erosion if it is dumped over the squeeze packer. Additionally, the tool is limited to moderate depths because of abrasive wear on the single cup.

A mechanically operated dump valve may be combined with the mechanically operated squeeze packer so that the J-mechanism, indexing or shifting mechanism, of the tool has three positions: "Unset", "Set/Treat", and "Dump". The "Dump" Position theoretically allows pressure equalization across the squeeze packer before unsetting and dumping of slurry below the tool without reverse circulation. However, tools of this type typically do not have a bypass passage, so that fluid displaced below the fracturing tool must be forcibly displaced "bullheaded" into formation zones located below the tool. This practice is undesirable due to potential formation damage. Tools of this type typically use a mechanical packer that is set by applying a set-down load from the tubing that is utilized to convey and position the tool. Use of a set-down load limits operation in deep deviated wells due to helical buckling of the coiled tubing because the coiled tubing cannot normally be used for transmission of set-down loads to the tool for setting of the packer. Further, anchoring slips on a mechanically energized packer are prone to jamming due to slurry dumped to the formation zones below the tool.

BRIEF SUMMARY OF THE INVENTION

It is a principal feature of the present invention to provide a treating tool which is conveyed by tubing, incorporates packers that are hydraulically energized and is capable of being shifted to any of four possible conditions or modes, "Set", "Treat", "Dump" and "Release" multiple times during one trip into a well.

It is a further feature of the present invention to provide a treating tool which is shifted to its various positions or modes by hydraulically controlled positioning, thus avoiding the need for application of set-down forces for tool actuation and providing effectively for coiled tubing conveyance of the tool and coiled tubing transmitted pressure for operation of the tool.

It is another feature of the present invention to provide a novel treating tool which maintains communication of casing sections above and below the formation interval straddled by the tool during the treating process to permit interchange of fluid within the well casing and across the formation being straddled by the treating tool.

It is also a feature of the present invention to provide a novel treating tool which provides for drainage of liquid that may be collected within the tubing above the tool and to provide for flushing through the tool.

Briefly, the invention is a tubing conveyed, multi-position straddle tool for fracturing or other formation treating operations that has a tubular housing carrying anchor devices and packer elements for anchoring and sealing the tool within a well casing. An inner tubular member is in telescopically movable assembly with the tubular housing and is positionable relative to the tubular housing to define the various positions or modes of the tool. The anchors and packers do not touch the wall of the casing when not energized, e.g. squeeze-type packers. The tool shifting mechanism, e.g. J-mechanism, has four positions: "Set", "Treat", "Dump", and "Release". The "Release" mode of the tool may also be characterized as an "Emergency Release" mode, which is achieved simply by applying an upward or lifting force to the inner tubular element and maintaining the lifting force until release of the tool has been accomplished. The J-mechanism is loaded in a direction opposing the lifting force by a nitrogen spring so that no set-down forces are required for actuation. The tool is anchored during operation by pressure actuated buttons at the upper end of the tool and is sealed with respect to the well casing by squeeze packers which are pressure energized. Further, a bypass passage is provided that extends through the tool to locations above and below the packers and which allows continuous communication between wellbore sections above and below the straddled interval with the tool anchored and sealed with respect to the well casing. The bypass passage permits fluid being pumped through the tool and into the casing below the tool to displace casing fluid upwardly through the tool to the casing above the tool. The treating tool is a multi-set tool which permits resetting in the downhole environment so that many formation treating activities may be accomplished without retrieving the tool from the well.

The treating tool of the present invention is capable of being indexed to its "Set", "Treat", "Dump" and "Release" conditions or modes without requiring application of a set-down force to the tool. The tool is activated to its anchored and set condition within the casing by hydraulic pressure, being a differential pressure that is achieved by the flow of fluid through a setting orifice. After having been anchored and set within the casing, the setting pressure is trapped so that the anchors maintain anchoring engagement within the casing and the packers remain energized. Thereafter, pumping may be stopped without releasing the tool from its set and energized condition. Shifting or indexing of the tool to its "Release" mode is achieved by applying an upward or pulling force to the inner tubular member and shifting or indexing of the tool to its "Set", "Treat" and "Dump" modes is achieved by pulling upwardly on the tool to move the inner tubular member upwardly relative to the anchored and sealed tubular housing and then relaxing the pulling force to permit downward movement of the inner tubular member by the nitrogen spring or other suitable urging means. Upward and downward movement of the inner tubular member relative to the tubular housing is controlled by an indexing mechanism also known as a J-mechanism.

BRIEF DESCRIPTION OF THE DRAWINGS

So that the manner in which the above recited features, advantages and objects of the present invention are attained may be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

IN THE DRAWINGS

Figure 1A:
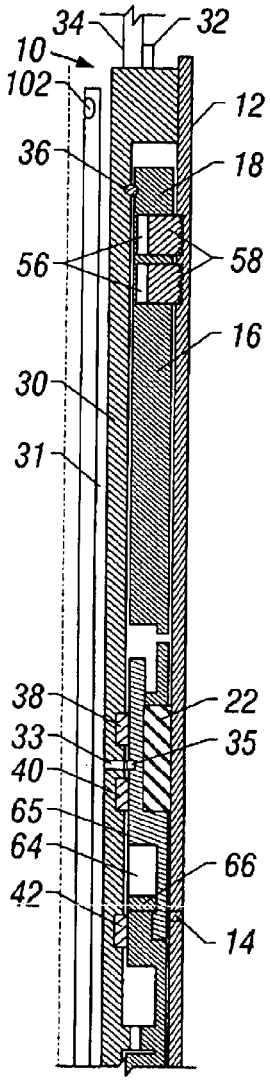
Figure 1B:
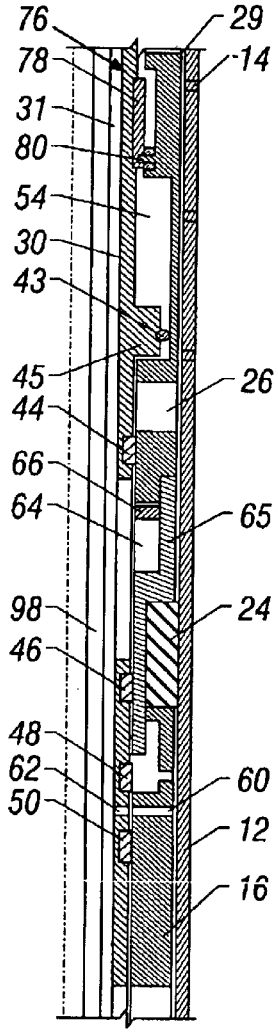
Figure 1C:
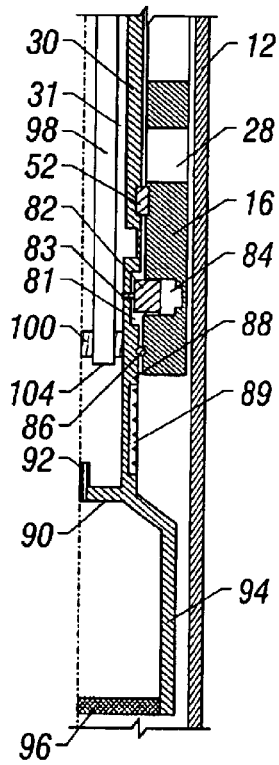
Figure 2A:
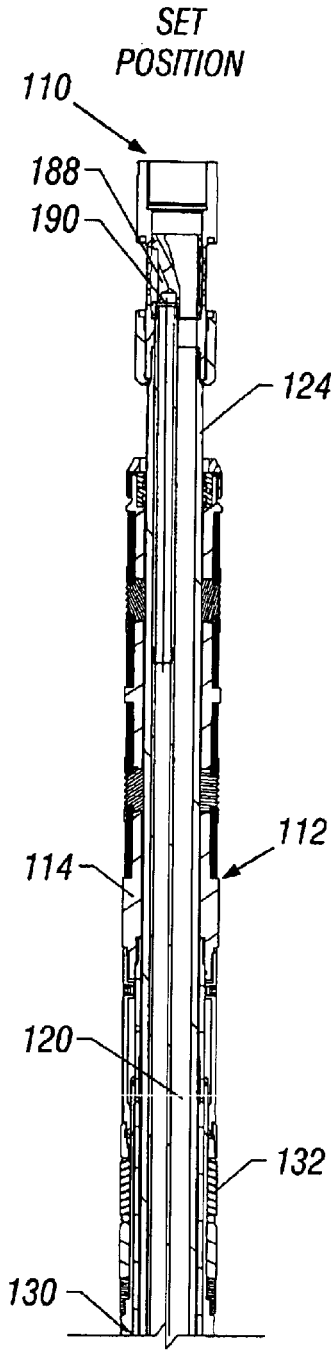
Figure 3A:
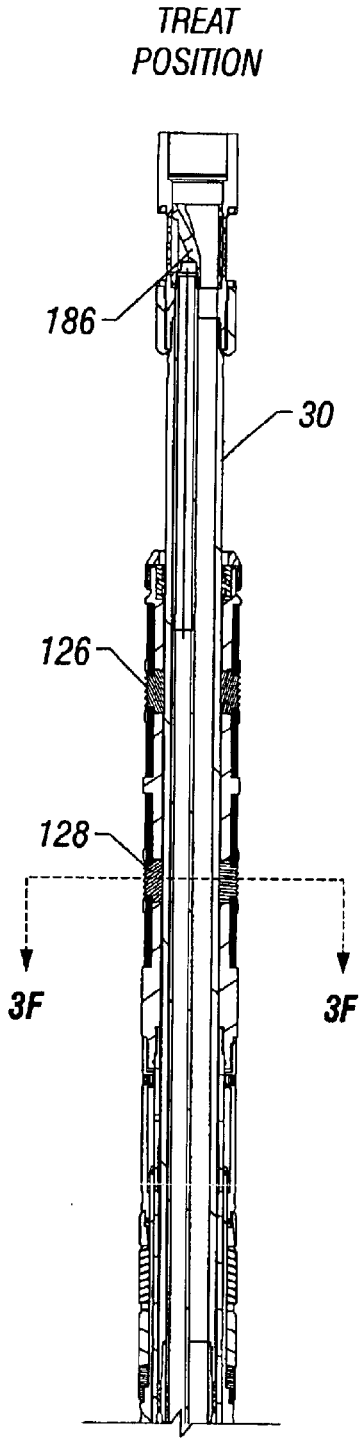
Figure 3F:
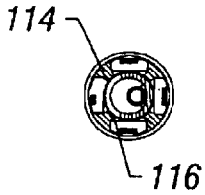
Figure 2B:
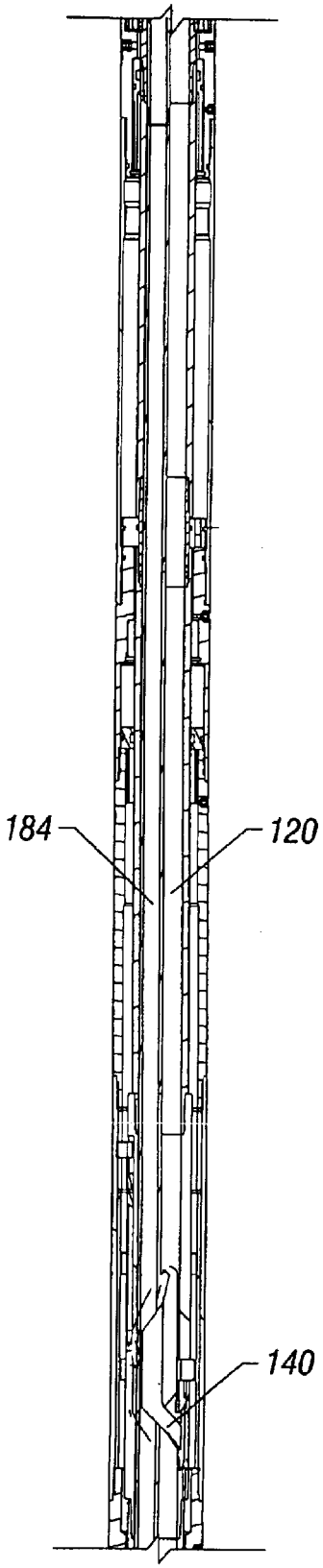
Figure 3B:
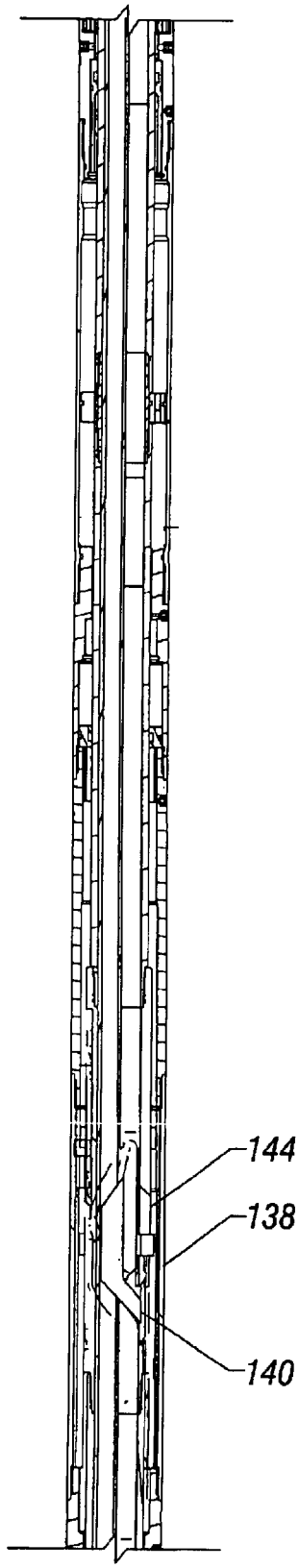
Figure 2C:
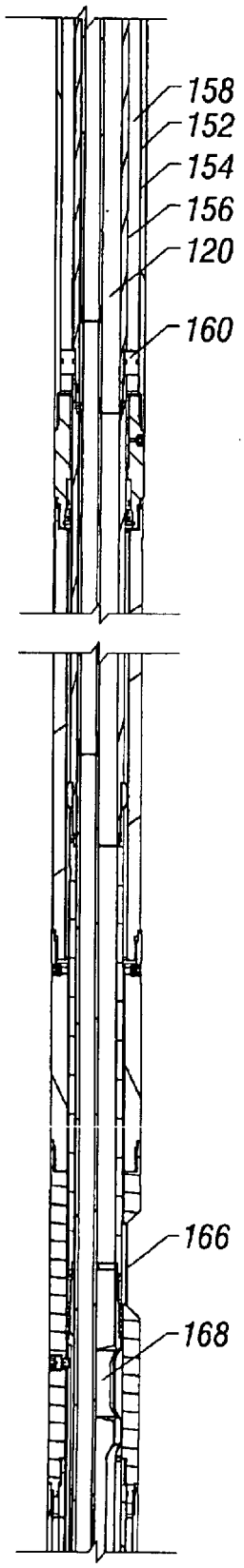
Figure 2D:
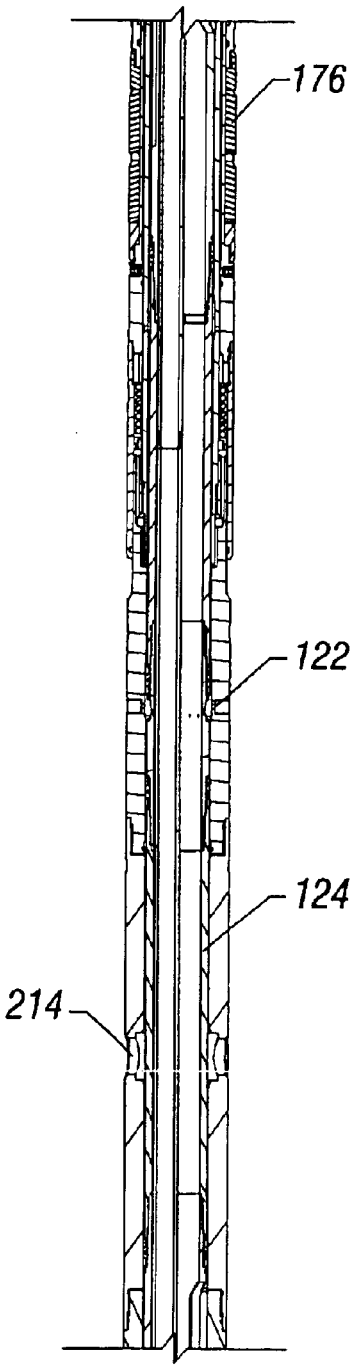
Figure 3D:
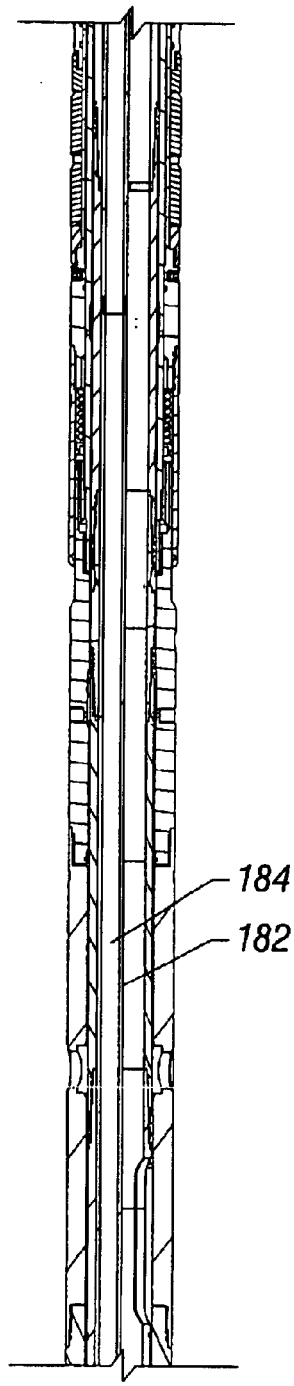
Figure 2E:
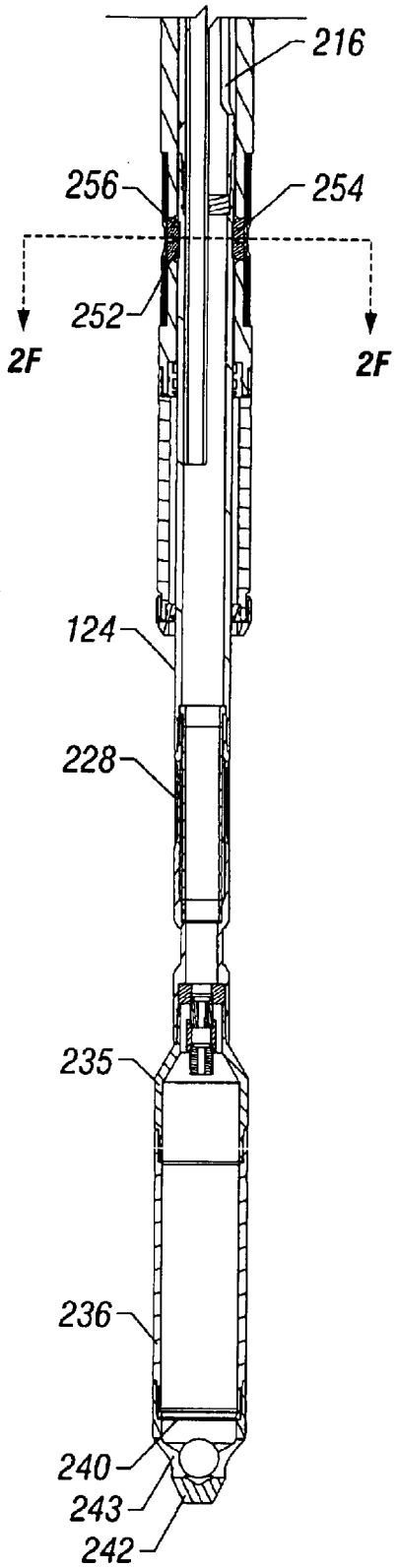
Figure 3E:
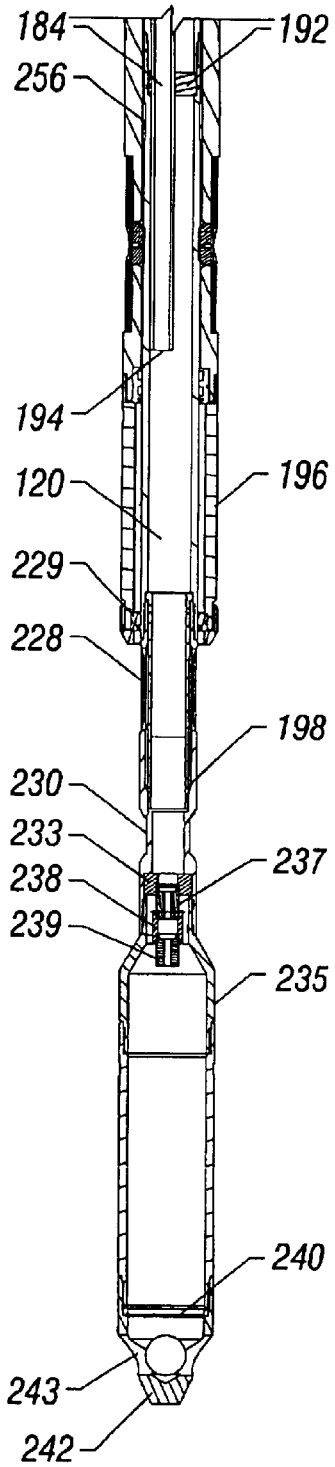
Figure 4A:
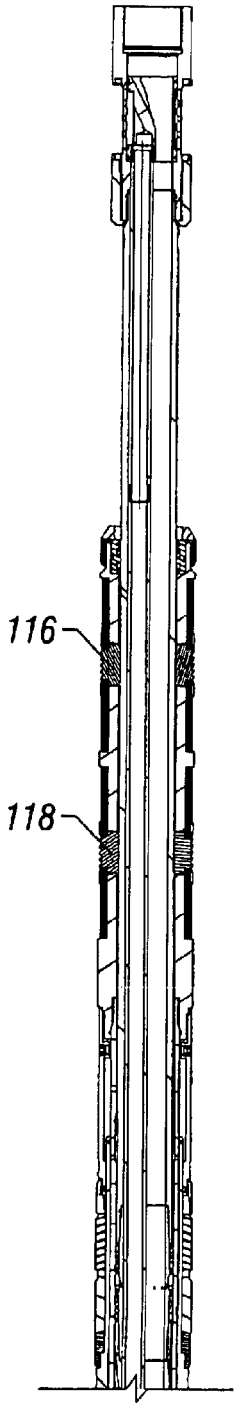
Figure 5A:
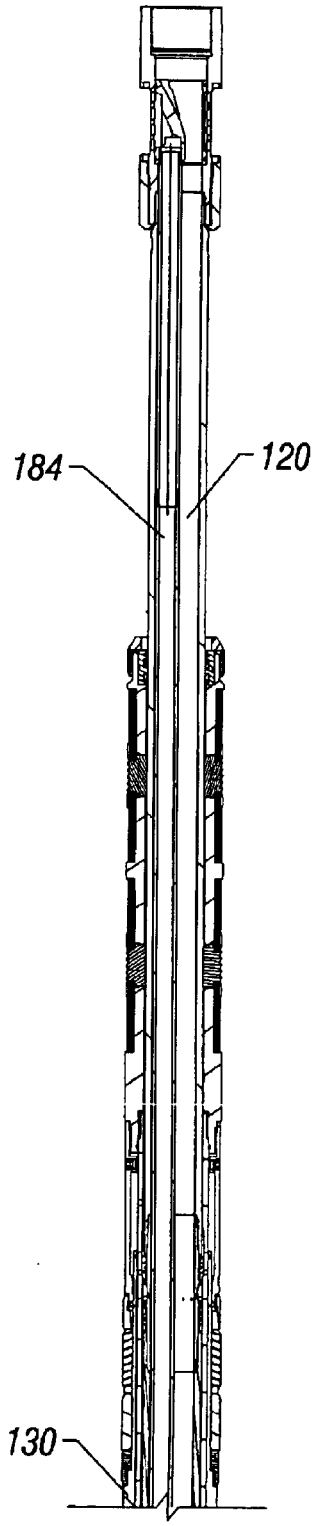
Figure 4B:
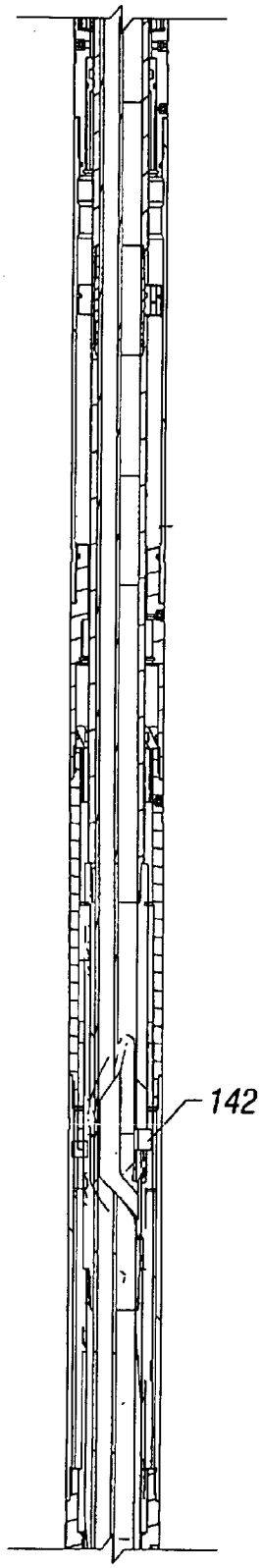
Figure 5B:
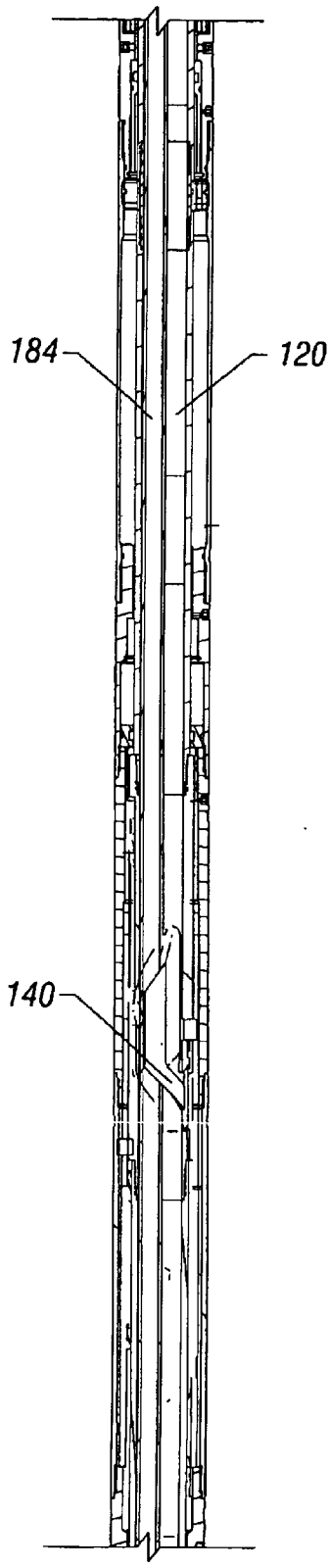
Figure 4C:
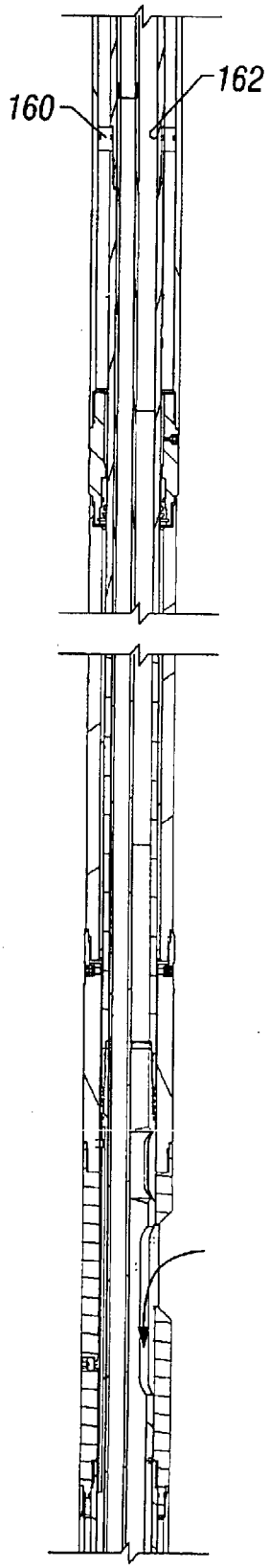
Figure 5C:
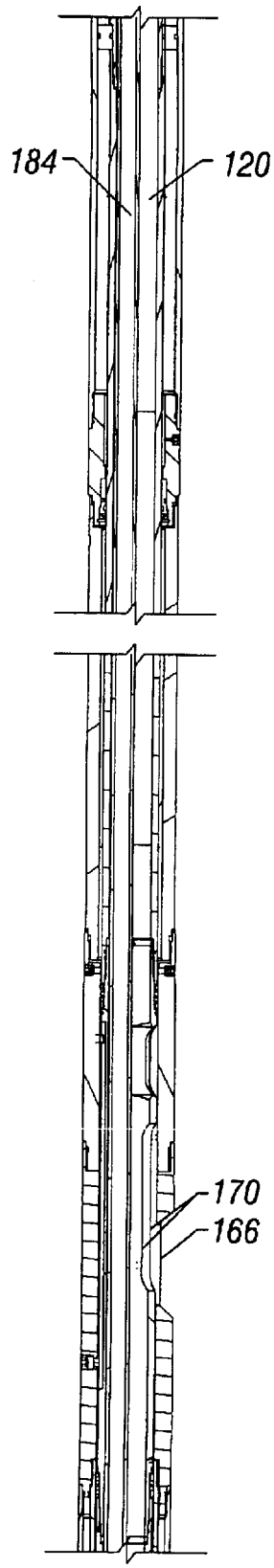
Figure 4D:
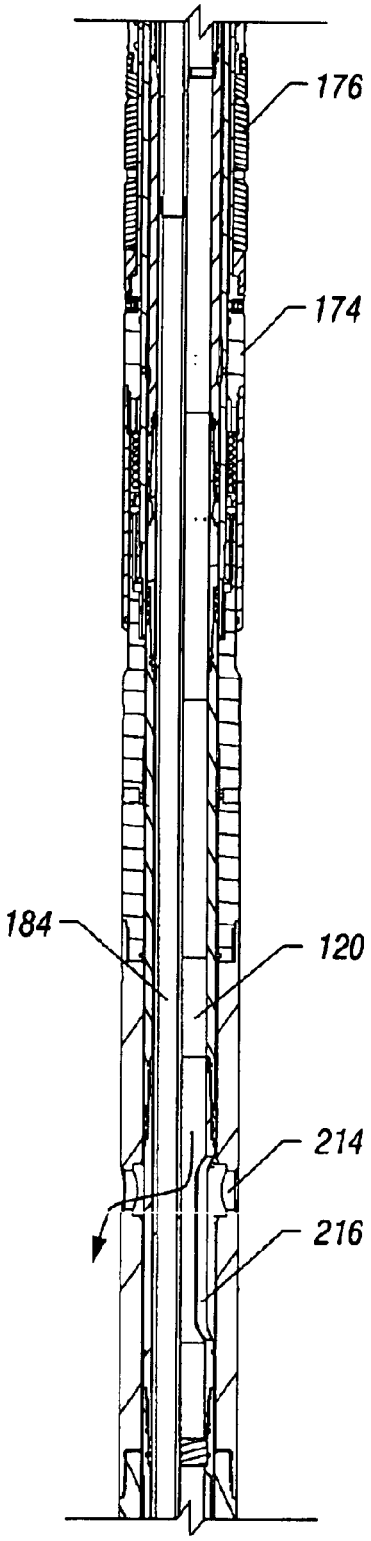
Figure 5D:
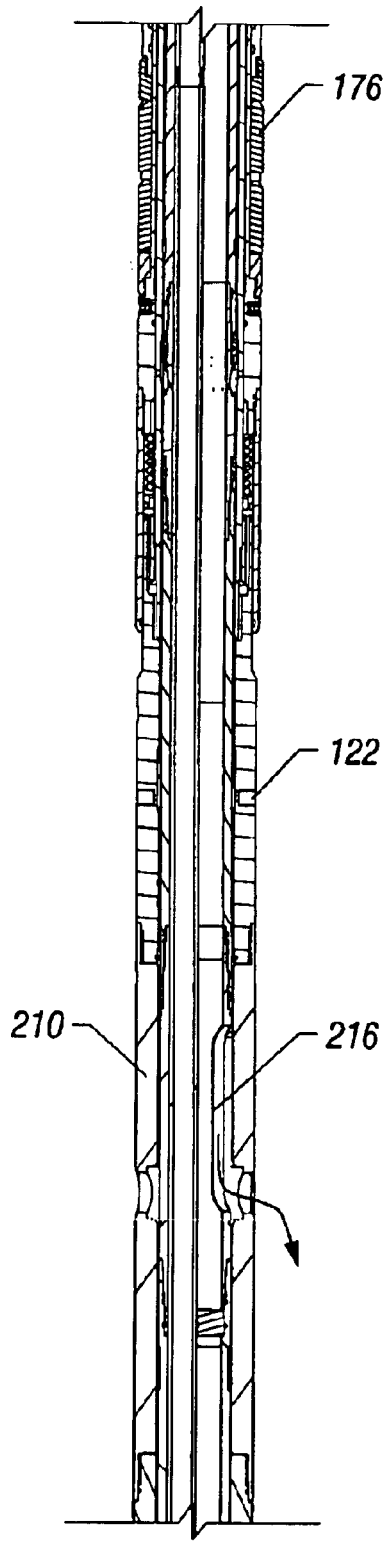
Figure 4E:
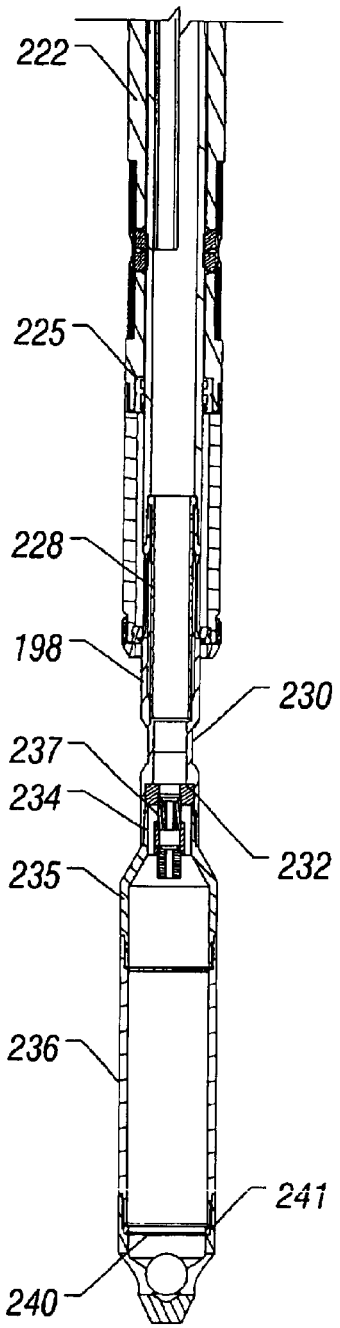
Figure 5E:
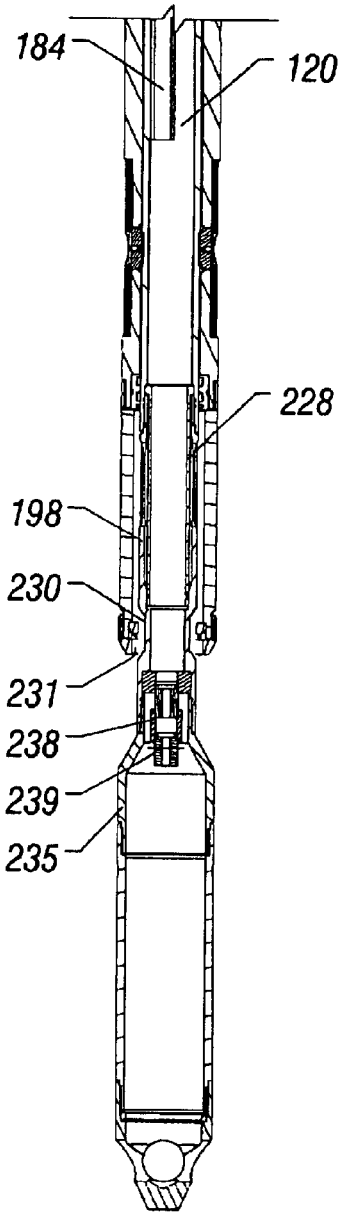
Figure 2F:
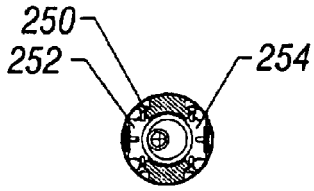
Figures 6, 7:
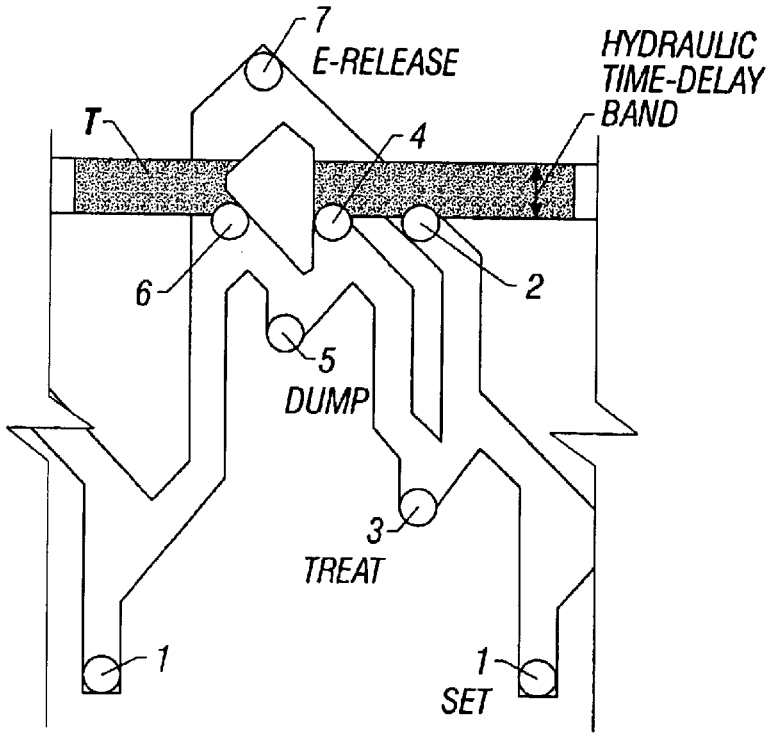

FIGS. 1A, 1B and 1C are schematic longitudinal sectional illustrations showing upper, intermediate and lower sections of a treating tool embodying the principles of the present invention, with the treating tool being situated in its "Set" Position or mode such as for running the tool into or retrieving the tool from a well;

FIGS. 2A, 2B, 2C, 2D and 2E are longitudinal sectional illustrations showing an upper section, three successive intermediate sections and a lower section of a tubing conveyed treating tool representing the preferred embodiment and best mode of the present invention and further illustrating the treating tool in its "Set" Position or mode;

FIG. 2F is a transverse sectional view taken along line 2F—2F of FIG. 2E and showing a temporary shear pin retained locking mechanism for releasably locking the tubular housing and inner tubular member at the "Set" Position of the tool;

FIGS. 3A, 3B, 3C, 3D and 3E are longitudinal sectional illustrations showing an upper section, successive intermediate sections and a lower section of the treating tool of FIGS. 2A–2E with the treating tool being illustrated in its "Treat" or "Fracture" Position or mode for injection of pressurized fluid into a selected formation for treatment thereof, FIG. 3F is a transverse sectional view taken along line 3F—3F of FIG. 3A and showing the details of the anchoring buttons or slips which secure the tubular housing of the treating ET tool with respect to the well casing;

FIGS. 4A, 4B, 4C, 4D and 4E are longitudinal sectional illustrations showing an upper section, successive intermediate sections and a lower section of the treating tool of the present invention and showing the treating tool in its "Dump" Position or mode for dumping or draining casing fluid and tubing fluid into the well below the tool to minimize the lifting weight that is required for retrieving the tool or moving it upwardly within the casing;

FIGS. 5A, 5B 5C, 5D and 5E are longitudinal sectional illustrations showing an upper section, successive intermediate sections and a lower section of the treating tool of the present invention and further illustrating the treating tool in its "Release" Position or mode, such as for emergency release of the tool from the well casing and drainage or dumping of casing and tubing fluids to provide for ease of retrieval or upward movement within the casing;

FIG. 6 is a diagrammatic indexing layout illustration of the indexing or J-mechanism for accomplishing positioning of the treating tool mechanism at the selective operational positions or modes of the tool; and FIG. 7 is a reference chart showing the "Set", "Treat" ("Fracture"), "Dump" and "Release" modes of the treating tool of the present invention and showing the conditions of various tool components at each of these modes and with reference to the indexing layout of FIG. 6.

DETAILED DESCRIPTION OF THE INVENTION

Referring now to the drawings and first to FIGS. 1A, 1B and 1C, schematic illustrations of the upper, intermediate and lower sections of the fracturing or treating tool of the present invention, shown generally at 10, are shown positioned within the casing 12 of a well in operative relation with perforations 14 that have previously been formed in the casing 12 by the firing of the perforating shaped charges of a perforating gun or other perforating device.

The fracturing or treating tool 10 comprises a tubular housing 16 having an upper anchoring section 18 which defines one or more anchor receptacles 56 within which one or more anchor devices 58, typically called "buttons" or "slips" are movably retained. The anchor devices 58 are movable from a retracted position out of contact with the inner surface of the casing 12 to an anchoring position in gripping or retaining engagement with the inner surface of the casing. When the anchor devices 58 are retracted, the fracturing tool 10 is easily movable into and out of the well casing by the coiled tubing. The anchor receptacles 56 are disposed in communication with the pressure of a fracturing or treating fluid that is pumped to the tool 10 through the coiled tubing, thereby providing for hydraulic energization of the anchor devices 58 simply by controlling the pressure of the fluid being pumped to the tool.

The tubular housing 16 also provides support for at least one and preferably a pair of spaced pressure energized packers, an upper packer 22 and a lower packer 24. Since the tool 10 is designed to be capable of formation fracturing, using a fracturing slurry as the pressurized fluid medium, a single packer tool may be used under circumstances where the desired section of the well casing below the tool is isolated, for example, by a lower bridge plug, dump sand plug or the like. In the case of fracturing tools employing spaced packers for isolation of a section of well casing therebetween, the upper packer is directly pressurized, i.e., settable, by the pressure of the fracturing or treating fluid within the straddled interval while the lower packer is energized by the hydraulic pressure of the treating fluid being pumped to the tool through the coiled tubing. Preferably, the packers are of the compression or squeeze type, being energized by the pressurized treating fluid and thus being subject to treatment pressure for sealing enhancement thereof. It should be noted, however, that the packers may also be of the inflatable type or the cup type. Pressure communication to the anchor devices 58 and the packers 22, 24 is such that predetermined initial pressure causes energization of the anchor devices for anchoring of the fracturing or treating tool 10 within the casing 12. Thereafter, increased pressure of the fracturing slurry or other treating fluid will cause the sealing capability of the packers to become enhanced responsive to the pressure of the fracturing slurry or other treating fluid. Thus, any pressure differential that might develop across the packers will not tend to shift the treating tool within the casing because the enhanced sealing capability of the packers also enhances the frictional resistance of the packers to pressure responsive movement.

An injection or fracturing port 26 is located within the tubular housing as shown in the intermediate tool section of FIG. 1B for conducting pressurized treating or fracturing fluid to an isolated annulus section 29 between the fracturing or treating tool 10 and the casing 12 and between the upper and lower packers 22 and 24. The pressurized treating or fracturing fluid is then conducted to the formation surrounding the casing via the perforations 14 for causing fractures in the formation. The treating or fracturing fluid is typically in the form of a slurry containing a particulate known as "proppant" which enters the pressure induced formation fractures and serves to prop the formation to prevent closure of the fractures. The proppant also assists in defining flow passages through the formation to enhance the flow of crude oil, natural gas and other formation fluids from the formation to the wellbore and thus enhance the production from the formation. It will be recognized that the treating fluid may be any of a range of fluids typically injected into earth formations for stimulating hydrocarbon production including, for example, acids, water, and fluids containing entrained gases such as nitrogen or carbon dioxide.

At its lower end the tubular housing 16 defines a dump port 28, shown in FIG. 1C, which is located below the lower packer 24 for conducting or draining released fluid from the coiled tubing, fracturing tool and the isolated annulus section 29 into the casing 12 below the tool 10. This condition occurs only at selected settings of the fracturing tool as will be discussed in detail below.

An inner tubular member 30 is linearly movable within the tubular housing 16 and defines an upper connector 32 that is preferably designed for connection with coiled tubing 34 that is used for running and retrieving the tool 10 and for conducting pressurized fluid to the tool for its anchoring and sealing within the casing and for accomplishing treatment of the formation that is isolated by the tool. Though coiled tubing is the preferred conveyance and fluid pressure supply for it the tool of the present invention, it should be borne in mind that it is not intended that the present invention be restricted solely to conveyance of the tool by coiled tubing. Within the spirit and scope of the present invention, other means for tool conveyance and fluid pressure supply, such as connected tubing sections, for example, may be utilized without departing from the spirit and scope of the present invention. Coiled tubing conveyance, however, provides for efficiency of formation treating procedures, especially when a significant number of production zones require treatment in order to improve the productivity of the well, while at the same time minimizing the cost and required time for the treating procedure. As mentioned above, coiled tubing is not typically utilized for running and retrieving treating tools because downward setting or indexing force is typically required. Since the tool of the present invention is actuated and indexed by tension force and spring return force, downward setting forces are not utilized. This feature permits effective utilization of the tool by coiled tubing conveyance.

The inner tubular member 30 is sealed with respect to the tubular housing 16 by seals 36, 38, 40, 42, 44, 46, 48, 50, 52 and is linearly movable in telescoping relation relative to the tubular housing 16 in an upward direction by means of tension force applied by the coiled tubing 34 and in a downward direction by means of a return spring force. Structure of the tubular housing 16 and inner tubular member 30 cooperatively define a variable volume return spring chamber 54 which is preferably filled with a compressed gas such as nitrogen to define a compressed gas type return spring, the return spring chamber 54 being sealed by an annular sealing member 43 that is supported by a piston section 45 of the inner tubular member 30. The compressed gas, i.e., nitrogen, provides a preload or motive force continuously urging the inner tubular member 30 downwardly relative to the tubular housing 16. If desired, the return spring force may be provided by a mechanical tension or compression spring or by both a compressed gas spring and a mechanical spring. Thus, the term "return spring" is intended to encompass a compressed gas spring or springs, a mechanical spring or springs, or both. The return spring will be further compressed or loaded when the inner tubular member 30 is being lifted by application of tension force to the coiled tubing 34. Since during relative return telescoping movement of the inner tubular member 30 and the tubular housing 16, the tubular housing 16 will be maintained immovable within the casing by the anchor device or devices 58 and by the expanded packers 22, 24, when the lifting force on the inner tubular member 30 is relaxed, the return spring will move the inner tubular member 30 downwardly relative to the static tubular housing 16.

As previously noted, for temporarily anchoring the tool 10 within the well casing 12 the tubular housing 16 defines one or more anchor receptacles 56 within which are movable one or more anchor button or slip devices 58. The anchor receptacles 56 are in fluid communication with the pressurized treating fluid that is injected into the fracturing tool 10 through the coiled tubing 34. The pumped or flowing treating fluid develops a pressure drop across a setting port 60, thus developing a "setting pressure" which is communicated via annular passages to the anchor receptacles 56 thereby providing a hydraulic motive force that moves the anchoring buttons or slips into retaining engagement with the inner surface of the casing 12. Setting pressure communication with the anchoring system is accomplished at the "Set" Position or mode of the tubular housing 16 and inner tubular member 30. In the "Set" and "Release" modes the setting pressure is vented so that the packers 22, 24 are released from their set positions and the anchor devices 58 are permitted to retract from their anchoring positions to thereby permit movement of the tool 10 within the casing 12 by the coiled tubing 34. One or more setting ports 62 are provided in the inner tubular member 30 for fluid communicating registry with the setting port or ports 60. Annular seals 48 and 50 maintain sealing between the tubular housing 16 and the inner tubular member 30 at all relative positions thereof.

It is necessary to maintain sealing of the tool with respect to the well casing so that fracturing or treating fluid may be injected into a relatively small volume zone of the casing. The tool 10 is thus provided with one or more pressure energized mechanical squeeze type packers, described briefly above as 22 and 24, which are moved from retracted positions into sealing engagement with the casing 12 in response to setting pressure which is conducted from the central passage 31 of the inner tubular member 30 to the tubular housing 16 by registering pressure transmitting ports 33 and 35 of the inner tubular member 30 and the tubular housing 16, as shown in FIG. 1A, which communicate injection pressure to a setting chamber 64. At the retracted positions of the packers, the packers 22, 24 are positioned out of contact with the casing 12, thus preventing wear or erosion of the packers during running and retrieving operations. The packers 22, 24 are typically activated by injection pressure in excess of the pressure that is required for activation of the anchoring devices 58. Thus, in response to increasing injection pressure, the anchoring devices 58 first establish anchoring to secure the tool 10 against movement within the casing 12. Then, as injection pressure is further increased, the packers 22, 24 will become pressure energized accomplishing sealing of the tool within the casing. The packers 22, 24 may have fluid pressure communication ports to the inner tubular member 30 for pressure-induced actuation by the pressure of the injection fluid of the coiled tubing. This feature causes the sealing capability of the packers 22, 24 to increase as the injection pressure pumped to the tool through the coiled tubing 34 is increased to fracturing or treating pressure. Seals 38 and 40 establish sealing between the inner tubular member 30 and the tubular housing 16 and confine injection pressure to the setting chamber 64. Anti-extrusion members located at the ends of the upper and lower packers 22, 24 also protect the sealing material of the packers from pressure induced extrusion by treating pressure acting within the casing 12 and between the packers. Thus, the packers 22, 24 may each be provided with anti-extrusion rings or assemblies at one or both of the axial ends thereof.

The sealing capability of the packers 22, 24 is further enhanced by injection pressure responsive devices acting laterally on the ends of the packers to enhance the sealing integrity of the packers responsive to the elevated pressure condition that is required for fracturing or treating of the formation. Thus, as the injection pressure is increased, the sealing integrity of the packers is also increased, to ensure against packer leakage and to prevent tool movement responsive to treatment pressure. Each of the spaced packers 22 and 24 is provided with an annular packer setting chamber 64 which is established by a setting piston housing 65 having a tubular housing section within which is movable a tubing pressure responsive setting piston 66. Fluid pressure from the injection passage 31 of the inner tubular member 30 is conducted into the setting chamber 64 and acts on the setting piston 66 and provides an enhanced downward urging force on the setting piston housing 65 which results in an axially acting force which mechanically compresses the upper and lower packers 22, 24 and causes them to develop an even tighter seal with the inner cylindrical wall of the casing 12 to prevent leakage during the elevated pressure conditions of fracturing and treating.

To enable the tool to achieve its various operative conditions there is provided an indexing mechanism, shown generally identified at 76, and shown in greater detail in the diagrammatic illustration of FIG. 6. The indexing mechanism is also identified as a J-mechanism which operates in response to relative linear positioning of the inner tubular member 30 and the tubular housing 16 which is achieved due to upward and downward movement of the inner tubular member 30 relative to the tubular housing 16. As mentioned above, the inner tubular member 30 is lifted after the tubular housing 16 has been secured and sealed to the well casing 12, with its packers 22, 24 straddling a selected interval. Since the tubular housing 16 will be static with respect to the casing 12 after anchoring and setting and during a fracturing or treating operation, upward movement of the tubing by a predetermined distance causes the indexing mechanism, i.e., J-mechanism, to shift from Position 1 ("Set") to Position 2, ("Treat"). With reference to the indexing layout illustration of FIG. 6, indexing of the tool between its positions is achieved by the J-mechanism which defines control slots within which a follower element moves during lifting and lowering of the inner tubular member 30. It should be borne in mind that the J-mechanism may define an internal or external indexing slot structure, with the slot follower being provided on the opposite one of the tubular housing 16 or the inner tubular member 30 as desired. With the indexing follower located at Position 1, the "Set" Position, lifting of the inner tubular member 30 causes the indexing follower to move upwardly within the indexing slot and then along the angulated portion of the slot to Position 2, causing relative rotation of the indexing mechanism during this movement. Lowering of the inner tubular member 30 from Position 2 then causes the follower to track downwardly in the indexing slot where it is diverted or cam actuated into the slot geometry at Position 3, which is the "Treat" or "Fracture" Position. In this position, the inner tubular member 30 is positioned above the position it assumes when at the "Set" Position of the tool mechanism. After the treating operation has been completed, it is typically desirable to dump pressurized injection fluid from the interval annulus surrounding the tool and to drain and flush the coiled tubing. This feature is accomplished by again lifting and indexing the inner tubular member 30, causing the indexing follower to track the indexing slot geometry from Position 3 to Position 4. From Position 3, as the inner tubular member 30 is lowered, the indexing follower will be guided to Position 5, the "Dump" Position. From Position 5, to return the tool mechanism to Position 1, the "Set" Position, the inner tubular member 30 is lifted from Position 5 to Position 6, thus accomplishing rotary indexing of the J-mechanism, and aligning the indexing follower with a substantially vertical slot section. The inner tubular member 30 is then lowered from Position 6 by relaxing the lifting force and the tapered section of the indexing slot geometry just beneath Position 6 is tracked by the indexing follower causing slight rotary indexing of the J-mechanism, permitting the indexing follower to be guided back to Position 1. Thus, for running and operation of the tool for the setting, treating and dumping activities, it is not necessary or desirable that the indexing follower track the indexing slot geometry to Position 7, the "Release" or "Emergency Release" Position of FIG. 6. In fact, to restrict movement of the indexing mechanism to the "Release" Position, a hydraulically controlled time delay "T" must complete its time delay sequence.

From any position, releasing of the anchors and packers, together with dumping of fluid from the interval annulus and the tubing is accomplished at Position 7, which is the "Release" or "Emergency Release" Position. Position 7 is achieved simply by lifting the inner tubular member 30 to the maximum extent permitted by the geometry of the indexing mechanism with the anchors and packers engaged and maintaining this lifting force to prevent the inner tubular member from moving downwardly. After the hydraulically controlled time delay sequence "T" has elapsed, the indexing mechanism will be permitted to move to Position 7, at which position the anchors and packers are vented and released, thus releasing the tool for movement within the casing.

Lifting and lowering of the inner tubular member 30 relative to the tubular housing 16 is accomplished by application of lifting force on the coiled tubing 34, but the distance of lifting and lowering of the inner tubular member is controlled by the geometry of the J-mechanism. Further lifting of the inner tubular member 30 by the tubing and then lowering of the inner tubular member 30 by the gas or mechanically energized return spring will cause the indexing mechanism to achieve the "Dump" Position or mode. Even further upward linear movement of the inner tubular member 30 by the coiled tubing will achieve the "Release" condition or mode of the tool, these positions being discussed in greater detail in the "Operation" section of this specification which is presented below. It should be borne in mind that the "Release" mode of the tool is achieved simply by a pulling force acting upwardly on the inner tubular member and by holding this pulling force a sufficient duration for expiration of a hydraulic time delay sequence which is illustrated by the horizontal time delay band "T" of FIG. 6. The indexing mechanism incorporates an external guide slot 78 which is defined by the inner tubular member 30 and a guide element 80 which is received by the guide slot 78. In the event the indexing mechanism is a J-type indexing mechanism, sections of the guide slots will generally define the configuration of a "J", which is well known in the industry for indexing control devices. If desired, the indexing may take any of a number of other indexing forms depending on the indexing activity that is desired. At the different axial positions of the tubular housing and the inner tubular member 30, various ports will be in registry to permit fluid flow and pressure transmission or pressure interchange or will be sealed off to prevent fluid flow or pressure transmission.

As is evident from FIG. 1C, during initial running of the tool to treatment depth, the tubular housing 16 and inner tubular member 30 are preferably locked together to prevent relative movement of the tubular housing and inner tubular member 30, to positively ensure that only the setting port remains open, and to permit fluid to be pumped through the tool and to permit well fluid to enter through the tool and fill the coiled tubing. When the tool reaches its initial treating depth it is desirable that the tubular housing and inner tubular member be released for relative movement as is dictated by the operational sequence for running, setting, treating, and retrieving or repositioning operations. A locking receptacle 81 of the inner tubular member 30 is defined, which is adapted to receive a pressure energized locking element 82 which is movable within a lock chamber 84 of the tubular housing 16. The locking element 82 may be temporarily retained in engagement within the locking receptacle 84 by shear pins 83 which are sheared by overpressurization of the inner tubular member 30 after the tool has become anchored and sealed at the initially selected interval to be treated. The locking element 82 may also be released for disengaging movement by a releasable collet latch or any other force responsive latch mechanism. To prevent fluid contamination of the locking mechanism, the locking receptacle 81 and lock chamber 84 are isolated from injection fluid and casing fluid by the annular seal 52 and by an annular sealing element 86, both of which establish sealing between the tubular housing 16 and the inner tubular member 30. The annular sealing element 86 establishes sealing with a return tube section 88 of the inner tubular member 30. The return tube section 88 is further provided with a transverse wall or partition 90 having a return orifice 92 situated therein. The return orifice 92 is preferably interchangeable so that differing return orifice dimensions may be established to accommodate differing dumping and slurry handling conditions. The return tube section 88 of the inner tubular member 30 also defines one or more dump or fluid interchange ports 89 through which fluid within the casing and within the coiled tubing and treating tool is dumped or drained into the well casing below the tool or flows from the casing and through the tool when the tube is positioned at its "Dump" and "Release" Positions. The return tube section 88 is also provided with an enlarged diameter tube section 94 having at its lower end a screen 96. The return tube and return orifice 92 enhance displacement of underflushed slurry in the "Dump" Position of the tool at a reduced flow rate to minimize the potential for clogging of the screen 96 by treatment fluid solids and to enhance settling of the solids within the casing below the tool. In Position 5 ("Dump"), the dump port 89 is sealed and wellbore fluid displaced during the dump operation is forced to flow through the screen 96 in the return tube section 88. The enlarged diameter of the return tube section 88 minimizes the flow velocity into the return tube which enhances settling of the slurry solids to the well below the tool. The return orifice 92 controls the flow velocity of displaced wellbore fluid when the coiled tubing hydrostatic head is significantly larger than the well hydrostatic head. In this case, the underflushed slurry tends to fall-out of the coiled tubing at a high flow rate potentially causing slurry solids to clog the screen 96 in the return tube section 88. As mentioned above, it is a feature of the present invention to provide for fluid communication of the casing section above and below the straddled interval when the tool is anchored and sealed within the casing for conduct of a formation treating operation. It is also a feature of this invention to maintain such communication during the treating process. For this purpose, within the central passage 31 of the inner tubular member 30 a bypass tube 98 is mounted by a transverse tube mounting and return orifice support partition 100. The bypass tube 98 defines upper and lower openings 102 and 104 each being above and below the upper and lower packers 22 and 24 respectively and with the opening 104 being located below the transverse tube mounting and return orifice support partition 100.

Operation

The operation of the tool is as follows. The tool is run-in-the-hole (RIH) on coiled tubing or other tubing, with the tool mechanism situated in Position 1 ("Set"). In this position a setting port or orifice 60 of the tubular housing 16 and 62 of the inner tubular member 30 are in registry and thus open, while all other ports are closed. This allows the coiled tubing to fill with well fluid while the tool is in the process of being run into the well casing by the coiled tubing to the depth of casing perforations located at the depth of the formation interval to be treated. The packers are relaxed and retracted and not touching the tubular wall of the casing. After reaching treating or fracturing depth, treating fluid or fracturing fluid, typically a slurry, is pumped through the coiled tubing at a specified rate that causes a pressure drop across the setting orifice, thus the higher pressure upstream of the setting orifice constitutes the "setting pressure" which energizes the anchoring mechanism for accomplishing anchoring of the tool within the casing. The pumping rate is increased, thus causing setting pressure to energize the packers for sealing of the tubular housing to the casing so that the packers straddle the selected interval. Thus, the setting pressure is applied to the anchoring buttons and packer elements initially causing the buttons to establish forcible anchoring engagement with the casing, and then the pressure energized packing elements are energized to achieve sealing thereof with the casing by the setting pressure for sealing the tool across the straddled interval. While continuing to pump the fracturing fluid through the tubing, so that the anchors and packers remain set, the coiled tubing is picked up then relaxed to the weight for running the tool into the casing (RIH), causing the indexing or J-mechanism to index the tool to Position 3 ("Treat" or "Fracture"). Lowering of the inner tubular member of the tool to its various operational modes or positions is accomplished by a return spring when the lifting force on the coiled tubing is relaxed. This return spring is preferably in the form of a pressurized gas spring, i.e., nitrogen, a mechanical spring, such as a tension or compression spring, or both. It is important to note that no set-down weight is required for shifting the tool mechanism to desired positions or modes as is typical for fracturing tools of this general nature. Thus, the tool of the present intention is well adapted for conveyance by coiled tubing or by any other suitable conveyance system.

After shifting to Position 3, pumping can stop and the setting pressure is trapped in the anchor buttons and the packer elements thus maintaining anchoring and sealing of the tool within the casing until it is subsequently released to permit tool movement within the casing. With the tool in Position 3, the "Treat" or "Fracture" Position, the treating fluid or fracturing fluid, typically in the form of a slurry, is pumped from the tool and into the annulus of the straddled interval through the injection or fracturing port, which is the only port at this tool mode which is open to the straddled interval of the casing. During treatment, the packer elements are further energized by the treating pressure acting on a setting piston to ensure reliable sealing of the packers at the elevated pressure that is necessary for formation fracturing or treating.

After the treatment is complete, the coiled tubing is picked up then relaxed to RIH weight causing the J-mechanism to index the tool to Position 5 ("Dump"). In this position the dump port and fracturing port are open allowing underflushed slurry in the coiled tubing to be pumped below the tool and to displace wellbore fluid through the bypass passage to the casing annulus above the tool. This also allows pressure equalization across the packer elements before unsetting the packers in preparation for tool movement, such as to another selected casing interval.

After dumping slurry, to eliminate or minimize fluid weight above the tool, the coiled tubing is picked up, causing the J-mechanism to move to Position 7 ("Release" or "Emergency Release"). In this position, the packing elements and anchor buttons are vented causing the tool to unset and return to Position 1 ("Set"). If the tool becomes jammed between Positions 1 and 2 or Positions 2 and 3 due to insufficient return spring load, the coiled tubing pickup load may be increased to cause the J-mechanism to shift to Position 7 ("Release" or "Emergency Release"). This feature may be "single-shot", i.e., requiring removal from the well for resetting or "re-settable" within the casing depending on the detailed design of the tool. The preferred embodiment of the present invention shows a re-settable design using a time-delay to separate the "Release" or "Emergency Release" Position from the normal "Set", "Treat" or "Fracture", and "Dump" Positions or modes.

The lower end of the inner tubular member 30 is specially configured with a return tube and return orifice 92 to enhance displacement of underflushed slurry in the "Dump" Position. In Position 5 ("Dump"), the dump port 89 is sealed and wellbore fluid displaced during the dump operation is forced to flow through the screen 96 in the return tube section 88. The above sequence is repeated for all zones to be treated in the wellbore; typically five to fifteen separate zones or intervals. Thus, the multi-set design of the preferred embodiment is a distinct advantage for formation treating when multiple production zones or multiple intervals of a single zone are to be treated.

FIGS. 2A–2E illustrate the "Set" Position or mode of the preferred embodiment or best mode of the tool of the present invention, being shown generally at 110, which is provided with a tubular housing shown generally at 112, defined by multiple interconnected housing mandrel sections. An anchoring mandrel section 114 defines anchor receptacles 116 and 118 (FIG. 4A) which receive setting pressure that is conducted from an injection passage 120 of the treating tool 110 through a setting port 122 (FIG. 2D). The setting pressure is developed by pumping treating fluid through the open setting port 122 which creates a pressure differential that energizes the anchors and the packers. The technical benefit of this arrangement is that to achieve a required pressure differential, an "open" setting system is not sensitive to fluid level (hydrostatic reference) in the well, while a "closed" setting system, i.e., no setting port, requires accurate knowledge of the hydrostatic reference. Thus, the setting activity of the tool will function efficiently at any depth within a well. The setting pressure traverses the tool to the anchor receptacles 116, 118 of the tubular housing 112 via small annular passages that are defined between the tubular housing 112 and an inner tubular member 124 which defines the injection passage centrally thereof. Anchoring buttons or slips 126 and 128 are movably retained within the anchor receptacles 116, 118 and are adapted for pressure responsive movement into anchoring or retaining engagement with the inner wall surface of the well casing. The sectional view of FIG. 3F shows anchoring buttons or slips arranged at 90° angular spacing to provide for anchoring of the tubular housing within the well casing and to provide for centering of the tool with respect to the casing. When the anchoring pressure is relieved at "Set" or "Release" Positions of the tubular housing and inner tubular member, explained in detail below, the anchor buttons will retract from engagement with the casing, thus releasing the tool for movement within the casing by the coiled tubing. Immediately below the anchoring mandrel 114 is connected an upper packer mandrel 130 defining a packer receptacle within which is located a pressure responsive upper packer element 132. During running and retrieving of the tool gauge rings or other protective structure may engage the inner surface of the well casing to prevent erosive contact of the packer elements with the casing, thus protecting the packers from becoming worn or damaged during upward or downward movement of the tool within the casing.

An indexing mandrel 138 is connected as a component of the tubular housing 112 and is provided with an indexing or J-mechanism 140 which indexes the tubular housing 112 and inner tubular member 124 to the "Set", "Treat", "Dump" and "Release" Positions or modes that are described above. The J-mechanism 140 is also discussed in connection with the layout illustration of FIG. 6. To prevent relative rotation of the tubular housing 112 and inner tubular member 124 during relative telescoping extension and contraction of the tool, guide elements 142 supported by the inner tubular member 124 have guiding engagement within longitudinal guide slots or tracks 144 that are defined within the tubular housing 112.

The tubular housing 112 is provided with a spring mandrel 152 having spaced tubular walls 154 and 156 which cooperate with other structure to define an annular spring chamber 158 which preferably contains a spring medium, such as a quantity of compressed gas, i.e., nitrogen. If desired, the spring medium may also be provided by a mechanical spring, such as a helical compression or tension spring. Also, if desired, the spring medium may be constituted by both a compressed gas spring and one or more mechanical springs functioning in concert. The spring medium provides continuous urging force against an annular piston 160 which is retained within a circular piston recess 162 of the inner tubular member 124 thus continuously urging the inner tubular member 124 downwardly relative to the tubular housing 112. Seals carried by the annular piston 160 maintain sealing with respect to the inner cylindrical surface of the tubular housing 112 and the outer cylindrical surface of the inner tubular member 124. Thus, with the tubular housing 112 temporarily anchored within the casing in preparation for or during a sequence, lifting of the inner tubular member 124 by the coiled tubing results in additional loading of the spring medium. It should be borne in mind that positioning of the inner tubular member 124 relative to the tubular housing 112 is controlled by the design geometry of the indexing slots of the J-mechanism 140 and not by the distance of movement of the inner tubular member 124 relative to the tubular housing 112. The inner tubular member 124 is lifted to the extent permitted by the J-mechanism and then the lifting force is relaxed to permit the J-mechanism to control the tool position that is to be achieved under the control of the J-mechanism. When the lifting force is dissipated, the continuous urging force of the spring medium moves the inner tubular member 124 downwardly, the downward movement being controlled by the J-mechanism 140, which shifts to its proper indexed position for location of the tubular housing 112 and inner tubular member 124 to the desired relative position that is next in the indexing sequence.

The tool is also capable of being moved to a "Release" or an "Emergency Release" position or mode regardless of its position at any point in time. This feature permits the fracturing tool mechanism to be moved from the "Set" Position, the "Treat" Position, or the "Dump" Position to the "Release" Position in the event movement of the tool is desired or in the event emergency conditions should arise. The "Release" mode is achieved, simply by lifting the inner tubular member 124 the desired distance permitted by the J-mechanism 140 and holding the pulling or lifting force via the coiled tubing for a sufficient period for a time delay sequence to have been completed preventing the inner tubular member 124 from being moved downwardly to the "Set" Position by the return spring force.

Figure 3C:
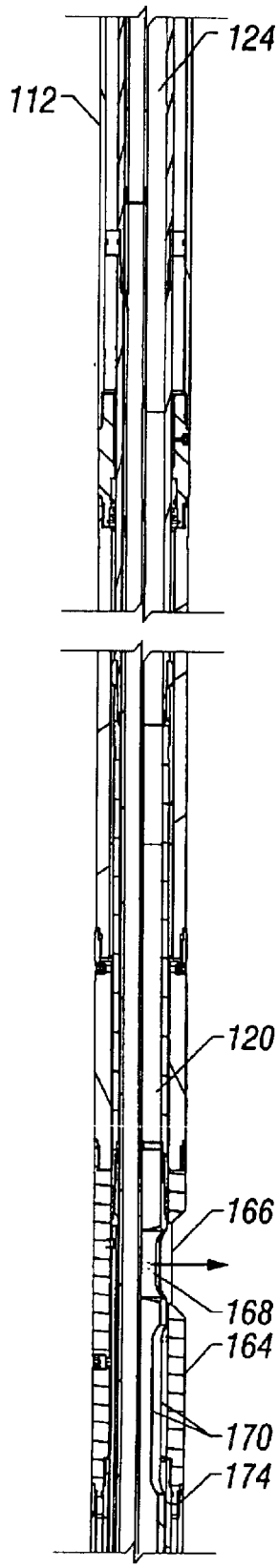

An injection port mandrel 164 is connected within the tubular housing 112 and defines one or more injection or fracture ports 166 permitting pressurized fracturing or treating fluid being pumped through the coiled tubing and the injection passage 120 of the inner tubular member 124 to be released into the straddled interval of the well casing for entry into the production formation surrounding the casing via the casing perforations. In the sectional view of FIG. 3C, a single slotted injection or fracture port 166 is defined by the injection port mandrel 164 of the tubular housing 112. The inner tubular member 124 defines a single large injection port 168 which is in fluid communicating registry with the slotted injection or fracture port 166 at the "Treat" Position of the tool as shown in FIG. 3C to permit substantially unrestricted injection of treatment fluid from the tool into the straddled annulus of the wellbore. As shown in FIG. 2C, the "Set" Position of the inner tubular member 124 relative to the tubular housing 112, the slotted injection or fracture port 166 is closed and sealed by the inner tubular member 124, thus preventing well fluid of the casing from entering the non-pressurized tool. The inner tubular member 124, in the region of the injection or fracture port 166, is provided with slotted fluid transfer ports 170 which are disposed in fluid transferring registry with the injection or fracture port 166 at the "Dump" and "Release" Positions of the tubular housing 112 and inner tubular member 124. In the "Set" Position of FIG. 2C, the injection or fracture port 166 is sealed since no fluid interchange is intended until the tool has been anchored and sealed within the casing. Fluid pressure pumped into the central passage 120 of the tool is intended only to shift the anchoring buttons 126 and 128 to their anchoring positions to anchor the tool within the casing and to then directly energize the upper packer to seal the upper portion of the tubular housing of the tool within the well casing. The lower packer is energized by the setting pressure which, as mentioned above, is the pressure differential that is achieved by flow of fluid through the setting port 122.

When the inner tubular member 124 has been raised and released and the J-mechanism 140 has established the "Treat" Position shown in FIGS. 3A–3E, injection ports 168 will be in fluid conducting registry with the injection or fracture ports 166 as shown. Thus, treating fluid being pumped through the coiled tubing and into the central passage 120 of the inner tubular member 124 will be discharged through the registering ports 166 and 168 into the sealed region of the casing between the packers and will be conducted into the surrounding formation through the casing perforations, accomplishing treating of the formation and accomplishing propping of the formation within the fractures.

FIGS. 4A–4E illustrate the "Dump" position or mode of the tool, which typically is established after a treating or fracturing operation has been completed. This position is established by further lifting of the inner tubular member 124 relative to the tubular housing 112 by application of upward force on the coiled tubing or other conveying and fluid supplying tubing followed by relaxing of the lifting force for indexing or positioning of the inner tubular member 124 by the indexing J-mechanism 140. When the "Dump" mode has been established, the slotted fluid transfer ports 170 of the inner tubular member are in fluid transferring registry with the injection or fracture port 166. In the "Dump" mode of the tool, fluid pumping through the coiled tubing will have stopped. The underflushed slurry within the coiled tubing and tool is permitted to drain or be pumped within the central passage 120 and fluid present in the casing interval between the packers will be permitted to enter the central passage 120 and also be drained into the well casing below the tool. With the tool in the "Dump" mode as shown in FIGS. 4A–4E, dump ports 214 and 216 of the tubular housing 112 and inner tubular member 124 will be in fluid communicating registry to permit fluid entering the central passage 120 from the straddled interval to flow into the casing below the lower packer 176.

The "Release" or "Emergency Release" Position or mode shown in FIGS. 5A–5E is established by lifting of the inner tubular member 124 relative to the tubular housing 112 to Position 7 of FIG. 6, the distance of lifting being restricted by the indexing slot geometry of the J-mechanism 140. The lifting force on the inner tubular member 124 is maintained when the "Release" or "Emergency Release" Position is achieved to maintain the lifted position until the time-delay sequence of FIG. 6 has elapsed, at which point the anchoring buttons 126, 128 will have retracted and the packers 132, 176 will have released their sealing engagement with the casing. At the "Release" Position the slotted fluid transfer ports 170 are disposed in fluid transferring registry with the slotted injection or fracture port 166 so that the fluid present within the casing and between the packers will be permitted to enter the central passage 120 and fluid within the coiled tubing and the central passage 120 of the tool will also be permitted to drain or to be pumped into the well casing below the tool. Also, because the bypass passage 184 of the inner tubular member 124 is present across the straddled interval, before release of the packers, fluid from the casing below the tool can be displaced upwardly across the straddled interval and into the casing annulus above the tool. This feature causes balancing of pressure across the packers 132, 176 and facilitates retraction of the packers to release sealing engagement with the casing. Simultaneously, the fluid pressure maintaining the anchoring buttons 126, 128 and the upper and lower packers in activated condition will be vented, thus completely releasing the tool from the casing. The relative positions of the fluid transfer ports 170 with respect to the injection or fracture port 166 is coordinated with relative positions of dump ports to be discussed in detail below. The "Release" Position or mode of the tool is provided for use particularly during emergency conditions when drainage of fluids and release of tool anchoring and sealing is desired.

Below the injection port mandrel 164, the tubular housing 112 is provided with a lower packer mandrel 174 which provides support for a lower fluid pressure energized packer 176, which may be substantially identical in construction and function as compared to the upper fluid pressure energized packer element 132. The lower packer element 176, when not energized, is retracted to a position out of contact with the casing, thus preventing its erosion or wear during running and retrieving operations. Preferably, the upper packer element 132 responds to direct compression by setting pressure. The lower packer element 176 is arranged for enhanced sealing actuation by fluid pressure communicated via the setting port 122 thus providing the lower packer with the capability for greater sealing than can be achieved by compression pressure. Fluid pressure from the setting port 122 is caused to act axially on the lower packer element 176 and to provide the packer with enhanced compression and sealing force. Further, when the packers 132, 176 have been set and the anchoring buttons 126, 128 have established anchoring retention with the well casing, the actuation pressure of the packers is trapped at the "Treat" and "Dump" positions of the tool which maintains the anchors and packers activated. Thus, injection pressure within the central passage 120 can be discontinued by cessation of pumping and the tool will remain anchored and sealed with respect to the casing. This feature permits the tool to be indexed to the "Treat" position in preparation for treating of the formation of the straddled interval and to be subsequently actuated to the "Dump" mode after a treating sequence has been completed without any risk of inadvertently moving the tool from the selected straddled interval within the casing.

As mentioned above, it is desirable to maintain communication of casing sections above and below the straddled interval when a treating tool is "Set" and sealed within a well casing. Heretofore, fracturing tools maintaining communication of casing sections above and below the straddled interval have not been available. In accordance with the principles of the present invention a bypass conduit 182 is supported within the inner tubular member 124 and defines a bypass passage 184 which extends from a point above the upper packer 132 to a point below the lower packer 176. At its upper end, the bypass conduit 182 is provided with a mounting and fluid communication fitting 186 having an inlet opening 188 that is in communication with an inlet opening 190 of the inner tubular member 124. The fitting 186 also serves to secure the upper end of the bypass conduit 182 within the inner tubular member 124. It should be borne in mind however that the bypass conduit 182 may be fixed within the inner tubular member 124 by welding or by any other suitable means of support. A bridge plug 192, shown in FIGS. 2E, 3E, 4D, 5D, is secured and sealed within the inner tubular member 124 as shown and serves to block the downward flow of fluid within the central passage 120 and also serves as a mounting structure for mounting the lower end of the bypass conduit 182 within the inner tubular member 124. The lower end of the bypass conduit 182 defines an opening 194 into the central passage 120 below the bridge plug 192 to permit fluid to flow upwardly or downwardly through the bypass passage 184 across the straddled interval. A return mandrel 196 defines a lower section of the tubular housing 112 and receives for relative movement an inner return mandrel 198 therein which defines a lower end section of the inner tubular member 124. The inner return mandrel 198 defines a plurality of elongate drain slots 228. An annular seal 229 is mounted within the lower end opening of the return mandrel 196 and establishes sealing between the return mandrel 196 and the inner return mandrel 198 at the "Set", "Treat", and "Dump" Positions of the tool. At the "Set" (FIGS. 2A–2E) and "Treat" (FIGS. 3A–3E) Positions of the tool, the drain slots 228 are located below the seal 229, thus permitting interchange of well fluid below the packers with the central passage 120 and with the bypass passage 184.

The tubular housing 112 is provided with a dump mandrel 210 having a dump sleeve which is provided with one or more dump ports 214. The dump ports may be suitably treated, or, for example, defined by hardened orifice inserts, if desired to minimize the potential for erosion of the dump ports by the proppant particulate that is typically entrained within fracturing slurry. The inner tubular member 124 in the region of the dump ports 214 of the tubular housing 112 is provided with a slotted section defining slotted dump ports 216. The slotted dump ports 216 are disposed in fluid conducting registry with the dump ports 214 only at the "Dump" Position of FIGS. 4A–4E and the "Release" Position shown in FIGS. 5A–5E. At the "Set" and "Treat" Positions of the tool, the slotted dump ports 216 and the dump ports 214 are isolated from communication. Thus the tubular housing 112 and the inner tubular member 124 and the positioning of the dump ports thereof constitute a mechanically operated dump valve mechanism which seals against fluid dumping in the "Set" and "Treat" modes and provide for controlled dumping of casing fluid and coiled tubing fluid in the "Dump" and "Release" modes of the tool.

Below the dump mandrel 210 of the tubular housing 112 is connected a return sleeve 222 into which the upper end of the inner return mandrel 198 of the inner tubular member 124 is movable in telescoping relation. The return sleeve 222 is sealed with respect to the lower portion of the tubular housing by an annular seal assembly 225 that also establishes sealing with the inner tubular member 124. In the "Dump" mode of FIGS. 4A–4E flow of fluid through the elongate drain slots 228 is prevented by an annular sealing member 229 which is retained within the lower end of the return mandrel 196. The inner return mandrel 198 defines an annular reduced diameter section 230 which, in the "Release" mode of the tool, is located within and in spaced relation with the annular seal 229 and defines a fluid flow path past the seal 229 to the outlet opening 231 of the return mandrel 196 of the tubular housing 112 to permit rapid flow of fluid from the central passage 120 into the well below the tool. At the "Set", "Treat" and "Dump" modes of the tool the annular reduced diameter section 230 is located below the lower end of the tubular housing as shown.

The inner return mandrel 198 defines a circular internal seat 232 within which an orifice support 233 is seated. The orifice support 233 is secured in position by an upper tubular retainer and connector section 234 of an enlarged diameter return housing 235 having an enlarged diameter elongate housing section 236 threadedly connected thereto. A return orifice member 237 is threaded into the orifice support 233 and defines an orifice flow passage that is of a dimension to suit the characteristics of the well that is being treated. In the "Dump" mode of the tool, fracturing slurry or treating fluid of the coiled tubing and fluid from the annulus of the straddled interval will drain or be pumped though the tool into the casing below the tool. The replaceable return orifice member 237 is designed to restrict or control the downward flow velocity of the slurry to minimize turbulence and thus enhance settling of the solids of the slurry in the well below the tool. The return orifice member 237 controls the flow velocity of displaced wellbore fluid when the hydrostatic head of the coiled tubing is significantly larger than the hydrostatic head of the well. In this case, the underflushed slurry tends to fall out of the coiled tubing at a high flow rate, potentially causing the slurry solids to clog the end filter 239 of the return tube. A filter support sleeve 238 is connected to the return orifice member 237, such as by threaded connection, and provides support for the end filter 239 through which fluid from the orifice must flow. The end filter element 239 further minimizes the turbulence of fluid from the orifice into the enlarged diameter return housing 235. The return housing 235 is provided with a replaceable screen element 240 which is retained to an annular screen seat by an upwardly facing annular retainer shoulder 241 of an end fitting 242 which is threaded to the elongate housing section 236. The end fitting is of downwardly converging tapered configuration and defines lateral openings 243 through which fluid flows into the casing below the tool.

During running of the tool it is desirable to temporarily lock the tubular housing 112 and inner tubular member 124 against relative movement to inactivate the internal gas pressure induced return force and to permit injection fluid to be continuously pumped through the tool and into the well casing as the tool is being run to position and then set. It is then desirable to release the locked condition of the tool and thereafter to permit setting and resetting of the tool by selective pumping of fluid to develop hydraulic pressure differential and pulling force for upward movement of the inner tubular member 124 relative to the tubular housing 112. As shown in the cross-sectional illustration of FIG. 2F, shear pins 250, which extend through threaded openings of the return sleeve portion 222 of the tubular housing 112, have shear end sections that are received within openings of lock elements 252 and 254 to releasably secure the lock elements within an annular locking groove 256 of the inner tubular member as shown in FIG. 2E. Thus, during initial running of the tool as a locked unit through the well casing, continuous pumping of fluid occurs. When the tool reaches the straddled interval, increased pump pressure causes setting of the anchors, followed by setting of the packers for anchoring and sealing the tubular housing relative to the well casing. The inner tubular member 124 is then released from its temporarily locked relation with the tubular housing by the application of internal pressure sufficient to cause shearing of the shear pins 250. When the pressure in the inner tubular member 124 is sufficient to shear the shear pins 250, release of the temporary lock occurs and the inner tubular member 124 is moved upwardly to the "Treat" Position shown in FIGS. 3A–3E. Thereafter, upward and downward movement of the inner tubular member 124 occurs by pulling force and by the force of the compressed gas spring medium as indicated above.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for treating one or more zones intersected by a wellbore having a casing therein, the casing being perforated at the well depth of said one or more zones for fluid communication therewith, said method comprising:

running a treating tool having at least one hydraulic pressure responsive anchor and at least one hydraulic pressure responsive packer and at least one treating port into the well by flexible tubing conveyance to the well depth of a selected casing interval to be isolated by the packer and with said treating tool in a "Set" mode with said anchor element and said packer element retracted to prevent contact thereof with the casing;

causing fluid pressure responsive hydraulic energization of said anchor and said packer with pressurized treating fluid conducted through said flexible tubing for securing and sealing said treating tool with respect to the casing;

causing treating fluid flow responsive hydraulic indexing of said treating tool to a "Treat" mode with said treating port in fluid communication with the tubing and in communication with the selected interval; and conducting pressurized formation treating fluid through the flexible tubing and through said treating port into the selected casing interval for treating the formation surrounding the selected casing interval.

2. The method of claim 1, further comprising:

repeating indexing said treating tool to said "Set" mode to relax said anchor and said packer and release said treating tool for tubing conveyance to other locations within the casing;

repeating said indexing of said treating tool to said "Treat" mode at the other locations; and repeating said conducting pressurized formation treating fluid through the tubing and through said treating port for formation treating at the other locations.

3. The method of claim 1, further comprising:

maintaining continuous communication of casing sections above and below said treating tool through an unobstructed bypass passage with said treating tool in at least one tool mode.

4. The method of claim 1, further comprising:

selectively indexing said treating tool within the casing to said "Set" mode for de-energizing said anchor and said packer;

moving said treating tool to a different casing interval; and repeating any selected number of times selective indexing of said treating tool at desired casing intervals to said "Treat" mode for treating the formation and then to said "Set" mode to prepare said treating tool for further movement to other selected intervals.

5. The method of claim 1, further comprising:

after treating of the formation, with treatment fluid flow generated force indexing said treating tool to a "Dump" mode opening at least one dump port therein, which may be selectively opened and closed, causing treatment fluid within said flexible tubing above said treating tool to be conducted through said treating tool and into the casing below said treating tool.

6. The method of claim 5, further comprising:

with said treating tool in said "Dump" mode causing hydraulic pressure acting on said anchor element and said packer to be trapped within said treating tool for maintaining hydraulic energization of said anchor element and said packer and maintaining said treating tool anchored and sealed within the casing;

releasing treating pressure from said selected interval to the tubing through said treating port; and conducting tubing fluid through said treating tool into the casing below said treating tool.

7. The method of claim 6, further comprising:

from said "Treat" mode or said "Dump" mode, applying a pulling force to said treating tool via the flexible tubing for indexing said treating tool to a "Release" mode and venting hydraulic pressure from said anchor and said packer and releasing engagement of said anchor and said packer from the casing to free said treating tool for tubing conveyance within the casing by selective movement of the flexible tubing.

8. The method of claim 7, further comprising:

for indexing of said treating tool to said "Release" mode, maintaining tubing pulling force on said treating tool for sufficient duration for completion of a hydraulically controlled time delay sequence.

9. The method of claim 1, further comprising:

with treatment fluid flow generated force indexing said treating tool to a "Dump" mode, causing treating fluid from said tubing to displace casing fluid below said treating tool through said treating tool and into the casing above said treating tool.

10. The method of claim 1, further comprising:

with said treating tool at said "Treat" mode, discontinuing hydraulic fluid pressure supply to said treating tool, said hydraulic pressure acting on said anchor element and said packer being trapped within said treating tool and maintaining said anchor element and said packer in anchoring and sealing contact with the casing.

11. The method of claim 1, wherein the treating tool defines at least one dump port being selectively opened and closed, said method further comprising:

indexing said treating tool to a "Release" mode and discontinuing pressurized treating fluid supply through the flexible tubing to said treating tool, said "Release" mode venting hydraulic pressure of said treating fluid acting on said anchor and said packer to release said anchor and said packer from anchoring and sealing contact with the casing and opening said dump port to conduct treating fluid within the flexible tubing through said treating tool and into the casing below the treating tool.

12. The method of claim 11, further comprising:

with said treating tool in said "Release" mode displacing casing fluid below said treating tool through an unobstructed bypass passage in said treating tool and into the casing above said treating tool.

13. The method of claim 1, wherein said treating tool comprises a tubular housing supporting said anchor and said packer and an inner tubular member being telescopically movable relative to said tubular housing and a mechanism urging said inner tubular member in one axial direction relative to said tubular housing, and wherein said tubular housing and said inner tubular member define at least one setting port, at least one treating port, and at least one dump port, said method further comprising:

at said "Set" mode opening only said setting port for filling said treating tool and the tubing with well fluid during running of said treating tool into the casing; and with said treating tool selectively located within the casing pumping fluid through said setting part at a rate developing sufficient differential pressure for energizing said anchor and said packer.

14. The method of claim 13, further comprising:

at said "Treat" mode opening said setting port for conducting pressurized treating fluid from the tubing through the treating tool to said packer for enhancing sealing contact thereof with the casing; and closing said dump port to prevent discharge of pressurized treating fluid from said tubing into the casing below said treating tool.

15. The method of claim 1, further comprising:

indexing said treating tool to a "Release" mode opening said treating port for flow of fluid from the formation to the tubing to depressurize the formation after treating; and opening a dump port in said treating tool to allow discharge of fluid from the tubing into the casing below said treating tool and to equalize pressure across said packer.

16. The method of claim 15, wherein, in said "Release" mode, the tubing fluid discharged into the casing below said treating tool displaces casing fluid below said tool through an unobstructed passage in said tool to the casing above said tool.

17. The method of claim 1, wherein said treating tool comprises a tubular housing and an inner tubular member being telescopically movable in one direction within said tubular housing by said tubing and a spring between said tubular housing and said inner tubular member telescopically urging said inner tubular member for movement in a second axial direction relative to said tubular housing, said indexing comprising:

lifting said inner tubular member by moving the flexible tubing upwardly;

relaxing said lifting force on said inner tubular member, said spring moving said inner tubular member downwardly relative to said tubular housing; and selectively indexing said inner tubular member to said "Treat" mode and a "Dump" mode responsive to lifting and lowering of said inner tubular member relative to said tubular housing.

18. The method of claim 1, wherein said treating fluid is fracturing slurry.

19. A method for treating one or more zones intersected by a wellbore having a casing therein, the casing being perforated at the well depth of said one or more zones for fluid communication therewith, said method comprising:

running a treating tool having a tubular housing having a treating port and having an inner tubular member movable within the tubular housing into the well casing by tubing conveyance to the well depth of a selected interval of the casing;

actuating at least one anchor device and at least one packer device by application of treatment fluid pressure and securing and sealing said tubular housing with respect to the casing and for isolating the selected interval;

conducting pressurized formation treating fluid through the tubing and inner tubular member and through said treating port into an annulus of the selected interval between said treating tool and the well casing for treating the formation of the selected interval; and with the treating tool in sealing relation with the casing, maintaining the casing above the treating tool in communication with the casing below the treating tool via an unobstructed bypass passage through the treating tool.

20. The method of claim 19, wherein said treating fluid is fracturing slurry.

21. A method for treating one or more zones intersected by a wellbore having a casing therein, the casing being perforated at the well depth of said one or more zones for fluid communication therewith, said method comprising:

running a treating tool into the well casing by coiled tubing conveyance to the well depth of a selected zone;

actuating at least one anchor device and at least one packer device by application of treatment fluid pressure and securing and sealing said treating tool with respect to the casing to establish an isolated section of the casing for fluid pressure induced treating activity;

applying lifting force to the coiled tubing and releasing the lifting force for spring induced force shifting said treating tool to a treating condition;

conducting pressurized formation treating fluid through the tubing and said treating tool into the isolated section of the casing for treating the formation of the selected zone;

further comprising applying lifting force to the coiled tubing in opposition to said spring induced force for shifting said treating tool from said treating condition to a dump condition permitting release of fluid within the tubing and treating tool into the casing below the treating tool, wherein, in said dump condition of the tool when the casing below the tool is filled with fluid, said fluid released into the casing below the treating tool displaces wellbore fluid below the tool through an unobstructed passage through the tool and into the wellbore above the tool.

22. The method of claim 21, further comprising:

applying lifting force to the coiled tubing and releasing the lifting force for actuating a J-slot type indexing mechanism and shifting said treating tool from said dump condition to a release condition releasing said securing and scaling of said treating tool relative to said casing to permit withdrawal of the treating tool from the casing by the tubing.

23. The method of claim 22, further comprising:

maintaining communication of casing sections above and below said treating tool in all modes of said treating tool.

24. The method of claim 21, wherein said treating fluid is fracturing slurry.

25. A coiled tubing conveyed treating tool for wells having a casing perforated at the well depth of at least one production zone, comprising:

a tubular housing having at least one pressure energized packer and at least one pressure energized anchor device for sealing and anchoring said tubular housing relative to the casing, said tubular housing having a treating port and a dump port;

an inner tubular member adapted for connection with the coiled tubing for coiled tubing conveyance within the casing and for pressurized treating fluid supply to said treating tool, said inner tubular member being movable to selected positions within said tubular housing and having at least one treating port and at least one dump port;

a spring continuously applying an urging force to said tubular housing and to said inner tubular member for moving said inner tubular member downwardly relative to said tubular housing; and a J-slot type indexing mechanism controlling selected positioning of said tubular housing and said inner tubular member to a plurality of modes relative to one another in response to linear cycling movement of said inner tubular member relative to said tubular housing by selective application of a pulling force to said coiled tubing and said inner tubular member and by said urging force of said spring upon relaxing of said pulling force;

further comprising structure defining an unobstructed fluid communicating passage within said inner tubular element for maintaining communication of casing sections above and below the treating tool at one of said modes of said treating tool.

26. The coiled tubing conveyed treating tool of claim 25, wherein said plurality of modes comprise "Set", "Treat", "Dump", and "Release" modes.

27. The coiled tubing conveyed treating tool of claim 26, further comprising a fluid filter.

28. The coiled tubing conveyed treating tool of claim 25, wherein said treating fluid supply is a fracturing fluid supply.

29. The coiled tubing conveyed treating tool of claim 25, further comprising an orifice defining a restriction in said fluid communicating passage to control the velocity of fluids flowing through said communicating passage and developing differential pressure across said orifice and a resultant force acting downwardly on said inner tubular member responsive to the flow of treatment fluid.

30. The coiled tubing conveyed treating tool of claim 25, wherein:

said tubular housing and said inner tubular member define a spring chamber having relatively movable walls defined respectively by said tubular housing and said inner tubular member; and said spring is at least one mechanical spring located within said spring chamber and continuously urging said tubular housing away from the tubing.

31. The coiled tubing conveyed treating tool of claim 25, wherein:

said tubular housing defines a treating port and a dump port longitudinally spaced from one another; and said inner tubular member defines at least one treating port and at least one dump port for selective registry with said treating port and said dump port of said tubular housing.

32. The coiled tubing conveyed treating tool of claim 25, further comprising:

at said "Set" mode a setting orifice being open permitting the tubing and said treating tool to fill with well fluid, said anchor device and said at least one pressure energized packer being inactivated to permit movement of said treating tool through the casing by the tubing and said treating and dump ports of said tubular housing and said inner tubular member being out of fluid communicating registry.

33. The coiled tubing conveyed treating tool of claim 25, further comprising:

at said "Treat" mode said tubular housing and said inner tubular member being positioned with said treating ports thereof in fluid communicating registry;

said dump ports of said tubular housing and said inner tubular member being positioned with said dump ports thereof out of fluid communicating registry; and said pressure energized packer and said pressure energized anchor device being energized for releasably anchoring said treating tool within the casing and releasably sealing the treating tool with respect to the casing.

34. The coiled tubing conveyed treating tool of claim 25, further comprising:

at said "Dump" mode said tubular housing and said inner tubular member being positioned to establish registry of said dump ports thereof and to establish registry of said treating ports thereof thus draining fluid from the tubing and the inner tubular member and achieving equalization of pressure across said at least one packer.

35. The coiled tubing conveyed treating tool of claim 25, further comprising:

at said "Release" mode said tubular housing and said inner tubular member being positioned to establish registry of said dump ports thereof and to establish registry of said treating ports thereof and said at least one pressure energized packer and said pressure energized anchor device being vented to permit retraction thereof to release positions.

36. The tubing conveyed treating tool of claim 25, further comprising:

said indexing mechanism defining an indexing slot geometry establishing said "Set", "Treat", "Dump" and "Release" modes;

an indexing follower on one of said tubular housing and said inner tubular member being engaged within said indexing slot geometry for controlling relative positioning of said tubular housing and said inner tubular member at said "Set", "Treat", "Dump" and "Release" modes, said inner tubular member being selectively raised and lowered relative to said tubular housing to accomplish indexing of said tubular housing and said inner tubular member to a selected one of said "Set", "Treat", "Dump" and "Release" modes.

37. The tubing conveyed treating tool of claim 36, further comprising:

a hydraulically controlled time delay restricting relative movement of said tubular housing and said inner tubular member to said "Release" mode until pulling force on said inner tubular member has been applied for the duration of said time delay; and said indexing mechanism permitting said "Release" mode to be achieved solely by pulling force on said inner tubular member via said coiled tubing and pemiitting said "Set", "Treat" and "Dump" modes to be achieved by applying a pulling force to said inner tubular member followed by relaxing of the pulling force to permit downward movement of said inner tubular member relative to said tubular housing.

38. A coiled tubing conveyed treating tool for wells having a casing perforated at the well depth of at least one production zone, comprising:

a tubular housing having at least one pressure energized packer and at least one pressure energized anchor device for sealing and anchoring said tubular housing relative to the casing, said tubular housing having a treating port and a dump port;

an inner tubular member adapted for connection with tubing for tubing conveyance within the casing and for pressurized treating fluid supply to said treating tool, said inner tubular member being movable to selected positions within said tubular housing and having at least one treating port and at least one dump port, said tubular housing and said inner tubular member defining a compressed gas reservoir having relatively movable walls defined respectively by said tubular housing and said inner tubular member;

a compressed gas spring within said compressed gas reservoir continuously applying an urging force to said tubular housing and to said inner tubular member for moving said inner tubular member downwardly relative to said tubular housing; and an indexing mechanism for selected positioning of said tubular housing and said inner tubular member to a plurality of modes relative to one another.

* * * * *